US010378355B2

(12) United States Patent
Kennedy et al.

(10) Patent No.: US 10,378,355 B2
(45) **Date of Patent: *Aug. 13, 2019**

(54) MINE STOPPING PANEL AND METHOD OF MANUFACTURE

(71) Applicant: Jack Kennedy Metal Products & Buildings, Inc., Taylorville, IL (US)

(72) Inventors: William R. Kennedy, Taylorville, IL (US); John M. Kennedy, Taylorville, IL (US)

(73) Assignee: Jack Kennedy Metal Products & Buildings, Inc., Taylorville, IL (US)

( * ) Notice: Subject to any disclaimer, the term of this patent is extended or adjusted under 35 U.S.C. 154(b) by 625 days.

This patent is subject to a terminal disclaimer.

(21) Appl. No.: 14/658,994

(22) Filed: Mar. 16, 2015

(65) Prior Publication Data

US 2015/0260041 A1 Sep. 17, 2015

Related U.S. Application Data

(60) Provisional application No. 61/954,158, filed on Mar. 17, 2014.

(51) Int. Cl.
*E21F 17/103* (2006.01)

(52) U.S. Cl.
CPC ..... *E21F 17/103* (2013.01); *Y10T 29/49826* (2015.01)

(58) Field of Classification Search
CPC ..... E21F 17/103
USPC ..... 454/169
See application file for complete search history.

(56) References Cited

U.S. PATENT DOCUMENTS 1,964,304 A * 6/1934 Techmer ..... E04B 2/825 52/242
3,499,672 A 3/1970 Sunasky
3,680,271 A 8/1972 Satchell
3,719,986 A 3/1973 Ardolino et al.
3,845,601 A * 11/1974 Kostecky ..... E04B 1/2403 403/242
4,193,245 A 3/1980 Johnson
(Continued)

OTHER PUBLICATIONS

Non-Final Office Action dated Feb. 12, 2016, U.S. Appl. No. 13/969,686, filed Aug. 19, 2013, (6) pgs.
(Continued)

*Primary Examiner* — Steven B McAllister
*Assistant Examiner* — Allen R Schult
(74) *Attorney, Agent, or Firm* — Stinson LLP

(57) ABSTRACT

A mine stopping panel and method of making it are disclosed. In one embodiment, the panel includes first and second channel-shaped panel members having a telescoping sliding fit one inside the other. An elongate end cap fitted in the first panel member. One or more connections between the first panel member and the end cap hold the end cap against movement relative to the first panel member when an extending force is applied to the end cap tending to telescopically extend the first panel member relative to the second panel member. At least one device on the end cap is configured for engagement with the first panel member to resist telescopic movement of the first end cap relative to the first panel member when a contracting force is applied to the first end cap. Other improved mechanisms for resisting contracting forces are disclosed.

25 Claims, 23 Drawing Sheets

(56) References Cited

U.S. PATENT DOCUMENTS

| | | | | |
|---|---|---|---|---|
| 4,333,672 | A | 6/1982 | Arthur et al. | |
| 4,397,127 | A | 8/1983 | Mieyal | |
| 4,483,642 | A | 11/1984 | Kennedy et al. | |
| 4,695,035 | A | 9/1987 | Kennedy et al. | |
| RE32,675 | E | 5/1988 | Kennedy et al. | |
| 4,820,081 | A * | 4/1989 | Kennedy | E21F 17/103 405/132 |
| RE34,220 | E | 4/1993 | Kennedy et al. | |
| 5,394,665 | A | 3/1995 | Johnson | |
| 5,644,879 | A | 7/1997 | Shreiner et al. | |
| 5,660,012 | A | 8/1997 | Knudson | |
| 5,930,968 | A | 8/1999 | Pullam | |
| RE36,853 | E | 9/2000 | Kennedy et al. | |
| 6,164,871 | A | 12/2000 | Kennedy et al. | |
| 6,402,611 | B1 | 6/2002 | Rohrbaugh | |
| 6,419,324 | B1 | 7/2002 | Kennedy et al. | |
| 6,568,138 | B1 | 5/2003 | Frost et al. | |
| 6,983,569 | B1 * | 1/2006 | Rosenberg | E04B 2/7457 52/238.1 |
| 7,267,505 | B2 | 9/2007 | Kennedy et al. | |
| 7,770,344 | B2 * | 8/2010 | Betz | H02G 3/385 52/126.6 |
| 7,850,390 | B2 | 12/2010 | Lisbona | |
| 9,447,684 | B2 * | 9/2016 | Kennedy | E21F 1/10 |
| 2005/0101243 | A1 | 5/2005 | Kennedy et al. | |
| 2015/0260041 | A1 | 9/2015 | Kennedy et al. | |

OTHER PUBLICATIONS

Prior Methods of attaching a sheet metal end cap to a sheet metal stopping panel as described in paragraph 4 of U.S. Appl. No. 14/658,994, filed Mar. 16, 2015; admitted prior art; 2 pages (1 and 2).

9 Photos showing a sheet metal end cap secured to a sheet metal stopping panel by draw-displacement connections; admitted prior art, (date unknown).

Attexor Clinch Systems SA, "TAGGER 320 Ultralight stitchfolding machine for sheet metal assembly", dated 2001, 2 pages; similar TAGGER machine used to connect a sheet metal end cap to a sheet metal stopping panel (admitted prior art).

Australian Patent Examination Report No. 1, dated Sep. 22, 2016, Patent Application No. 2013206839, (3) pgs.

Notice of Allowance dated Jul. 18, 2018, U.S. Appl. No. 15/176,873, 36 pages.

Office Action dated Feb. 12, 2016, U.S. Appl. No. 13/969,686, 19 pages.

Notice of Allowance dated May 25, 2016, U.S. Appl. No. 13/969,686, 15 pages.

* cited by examiner

MINE STOPPING PANEL AND METHOD OF MANUFACTURE

CROSS REFERENCE TO RELATED APPLICATIONS

This application claims priority to U.S. Provisional application No. 61/954,158, filed Mar. 17, 2014, the entire contents of which are hereby incorporated by reference.

FIELD OF THE INVENTION

The present invention generally relates to mine ventilation equipment, and more particularly to mine stopping panels used in mine ventilation systems.

BACKGROUND OF THE INVENTION

Mine stopping panels are used to control the flow of air through mine passages. Mine stopping panels of the type sold by Jack Kennedy Metal Products & Buildings, Inc. are described in U.S. Pat. Nos. 4,483,642, 4,695,035, 4,820,081, and 7,267,505, all of which are incorporated by reference herein. These panels generally comprise first and second sheet metal panel members having a telescoping sliding fit one inside the other. Optionally, channel-shaped end caps are attached to the panel members at opposite ends of the panel. The panel members are extended to bring seals in the end caps into sealing engagement with the floor and roof of a mine passage. The attachment of the end caps to respective panel members has been achieved in different ways.

One method of attachment was a simple draw-displacement connection in which a punch punches a depression in two sheets (one sheet of the panel member and another sheet of the end cap), shearing on two opposite sides and stretching the other two. The punch coins (displaces) the material pushed through against an anvil to make it quite a bit bigger than the slot from which it came. Another method was basic resistance (spot) welding or MIG welding. Still another method involved punching a small hole that was sheared on three sides through both sheets, and then folding the resulting tab back against the bottom of the bottom sheet. Another method was similar to a desk stapler. Very hard wire was forced through the sheets and folded against the bottom sheet. All of these methods have various drawbacks.

There is a need, therefore, for an improved mechanism for connecting the ends caps to respective panel members.

SUMMARY OF THE INVENTION

In one embodiment, a mine stopping panel incorporating an improved connecting mechanism of this invention comprises first and second elongate panel members of channel shape, each panel member having a web, first and second flanges at opposite sides of the web, and in-turned lips at outer edges of the flanges. The first and second panel members have a telescoping sliding fit one inside the other along an axis extending lengthwise of the panel members. A first end cap extends between the first and second flanges of the first panel member on an inside surface of the web of the first panel member. A first set of one or more louver connections between the first panel member and the first end cap hold the first end cap against movement relative to the first panel member when an extending force is applied to the first end cap tending to telescopically extend the first panel member relative to the second panel member in a first direction along the long axis of the panel members. At least one device (e.g., at least one bendable tab) on the first end cap is configured for engagement with the first panel member to resist telescopic movement of the first end cap relative to the first panel member when a contracting force is applied to the first end cap tending to telescopically contract the first panel member relative to the second panel member in a second direction along the axis opposite the first direction.

In another embodiment, the mine stopping panel comprises first and second elongate panel members of channel shape, each panel member having a web, first and second flanges at opposite sides of the web, and in-turned lips at outer edges of the flanges. The first and second panel members have a telescoping sliding fit one inside the other along an axis extending lengthwise of the panel members. The panel also includes an end cap extending between the first and second flanges of the first panel member on an inside surface of the web of the first panel member. A tab on at least one of the first and second flanges is configured for engagement with the end cap to resist telescopic movement of the end cap relative to the first panel member when a contracting force is applied to the first end cap tending to telescopically contract the first panel member relative to the second panel member.

This invention is also directed to a method of making a mine stopping panel. The method comprises the steps of: forming an elongate channel-shaped panel member having a longitudinal axis, a web, first and second flanges at opposite sides of the web, and in-turned lips at outer edges of the flanges; forming an elongate end cap having opposite ends; forming a first bendable tab on either the panel member or the end cap before the panel member and end cap are assembled; assembling the formed panel member and the formed end cap so that the end cap extends across the web of the panel member in a position in which the ends of the end cap are adjacent respective first and second flanges of the panel member and the end cap is positioned between the web and in-turned flanges of the panel member; making at least one connection between the panel member and the end cap to hold the end cap against movement relative to the first panel member along the longitudinal axis of the panel member in a first direction; and bending the first tab into a position in which it extends from either the panel member or the end cap for engagement with the other of the panel member and the end cap to resist movement of the end cap relative to the panel member along the longitudinal axis in a second direction opposite the first direction.

Other objects and features will be in part apparent and in part pointed out hereinafter.

BRIEF DESCRIPTION OF THE DRAWINGS

Corresponding reference characters indicate corresponding parts throughout the drawings.

DETAILED DESCRIPTION

Figure 1:
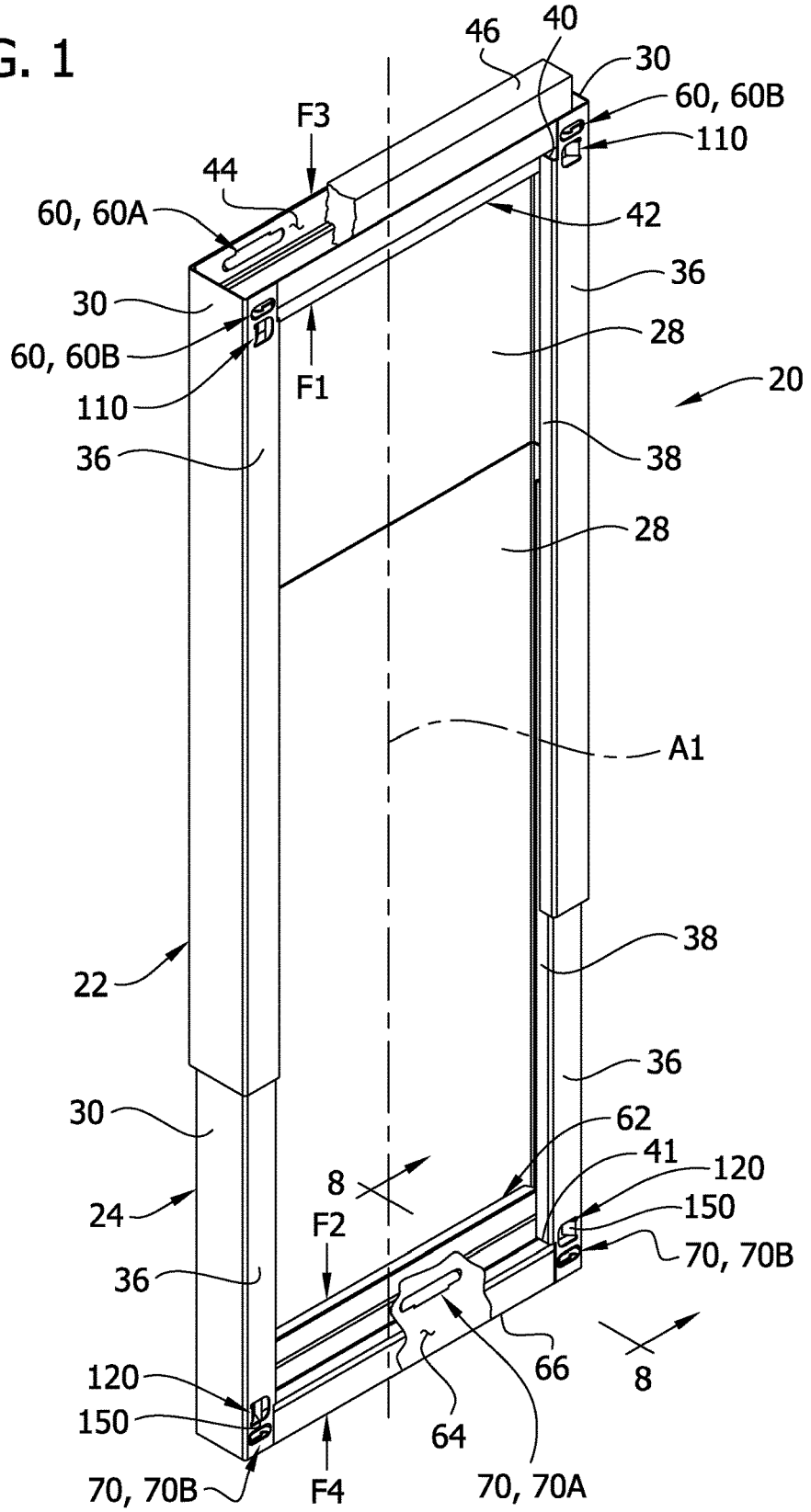
FIG. 1 is a perspective of a mine stopping panel of this invention in which end caps of the panel are attached to respective panel members by louver connections.
Figure 2:
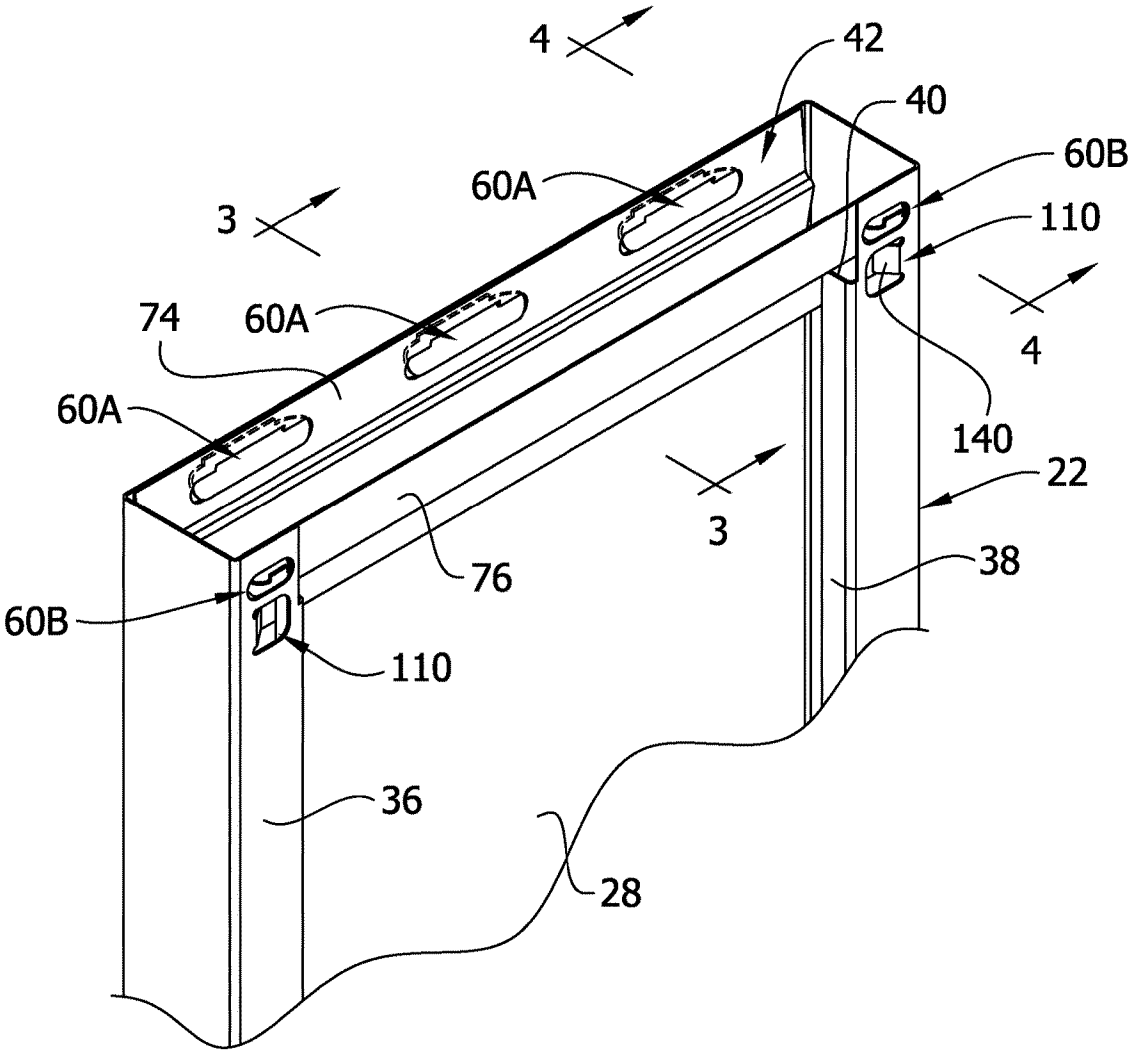
FIG. 2 is an enlarged upper end portion of the stopping panel of FIG. 1, an upper seal being removed from the upper end cap to show details.

Referring to FIG. 1, a mine stopping panel of this invention is designated in its entirety by the reference number 20. The panel comprises first (upper) and second (lower) elongate panel members 22, 24 of channel shape. Each panel member 22, 24 has a web 28, first and second flanges 30 at opposite sides of the web, and in-turned lips 36 at outer edges of the flanges. In the illustrated embodiment, the in-turned lips have edge margins 38 bent back toward the web 28 in a direction generally parallel to the flanges 30. The edge margins 38 of the upper panel member 22 have upper end edges 40 terminating short of the upper end of the panel member 22. Similarly, the edge margins of the lower panel member 24 have lower end edges 41 terminating short of the lower end of the panel member 24. The first and second panel members have a telescoping sliding fit one inside the other along an axis A1 extending lengthwise of the panel members 22, 24. Desirably, the panel members 22, 24 are formed from sheet metal or other suitable material.

An elongate first end cap, generally designated 42, extends between the first and second flanges 30 of the first (upper) panel member 22 on an inside surface of the web 28 of the first panel member at an upper end of the panel 20. In general, the first end cap 42 has a length sized for a relatively loose fit between the flanges 30 of the upper panel member 22, and a width at its top sized for a relatively loose fit between the web 28 of the panel member and the in-turned lips 36 of the panel member 22. (The relatively loose fit provides room for the panel member 22 to contract horizontally in the event of pillar expansion. That is, the flat web 28 of the panel member can buckle outward.) The first end cap 42 defines a first cavity 44 for receiving a first end seal 46 for sealing engagement with a first mine surface, such as the roof of a mine passage. A first set of one or more louver connections, each generally indicated at 60, between the first panel member 22 and the first end cap 42 hold the first end cap against movement relative to the first panel member 22 when an extending force F1 (FIG. 1) is applied to the first end cap tending to telescopically extend the first panel member relative to the second panel member 24 in a first direction (typically vertically upward) along the axis A1 of the panel members to bring the first end seal 46 into pressure engagement with the first mine surface (e.g., the roof of a mine passage). A jack may be used to generate the extending force, as described in co-assigned U.S. Pat. No. 7,267,505. Other extension mechanisms may also be used.

Similarly, an elongate second end cap, generally designated 62, extends between the first and second flanges 30 of the second panel member 24 on an inside surface of the web 28 of the second panel member at a lower end of the panel 20 (see FIG. 1). In general, the second end cap 62 has a length sized for a relatively loose fit between the flanges 30 of the lower panel member 24, and a width at its bottom sized for a relatively loose fit between the web 28 of the panel member 24 and the in-turned lips 36 of the panel member. (The relatively loose fit provides room for the panel member 24 to contract horizontally in the event of pillar expansion. That is, the flat web 28 of the panel member can buckle outward.) The second end cap 62 defines a second cavity 64 for receiving a second end seal 66 for sealing engagement with a second mine surface, such as the floor of a mine passage. A second set of one or more louver connections, each generally indicated at 70, between the second panel member 22 and the second end cap 62 hold the second end cap against movement relative to the second panel member 22 when an extending force F2 (FIG. 1) is applied to the second end cap tending to telescopically extend the second panel member 24 relative to the first panel member 22 in a second direction (typically vertically downward) along the axis A1 of the panel members to bring the second end seal 66 into pressure engagement with the second mine surface (e.g., the floor of a mine passage). As noted above, the jack described in co-assigned U.S. Pat. No. 7,267,505 may be used to apply the extending force. Alternatively, other extension mechanisms may be used.

Figure 4:
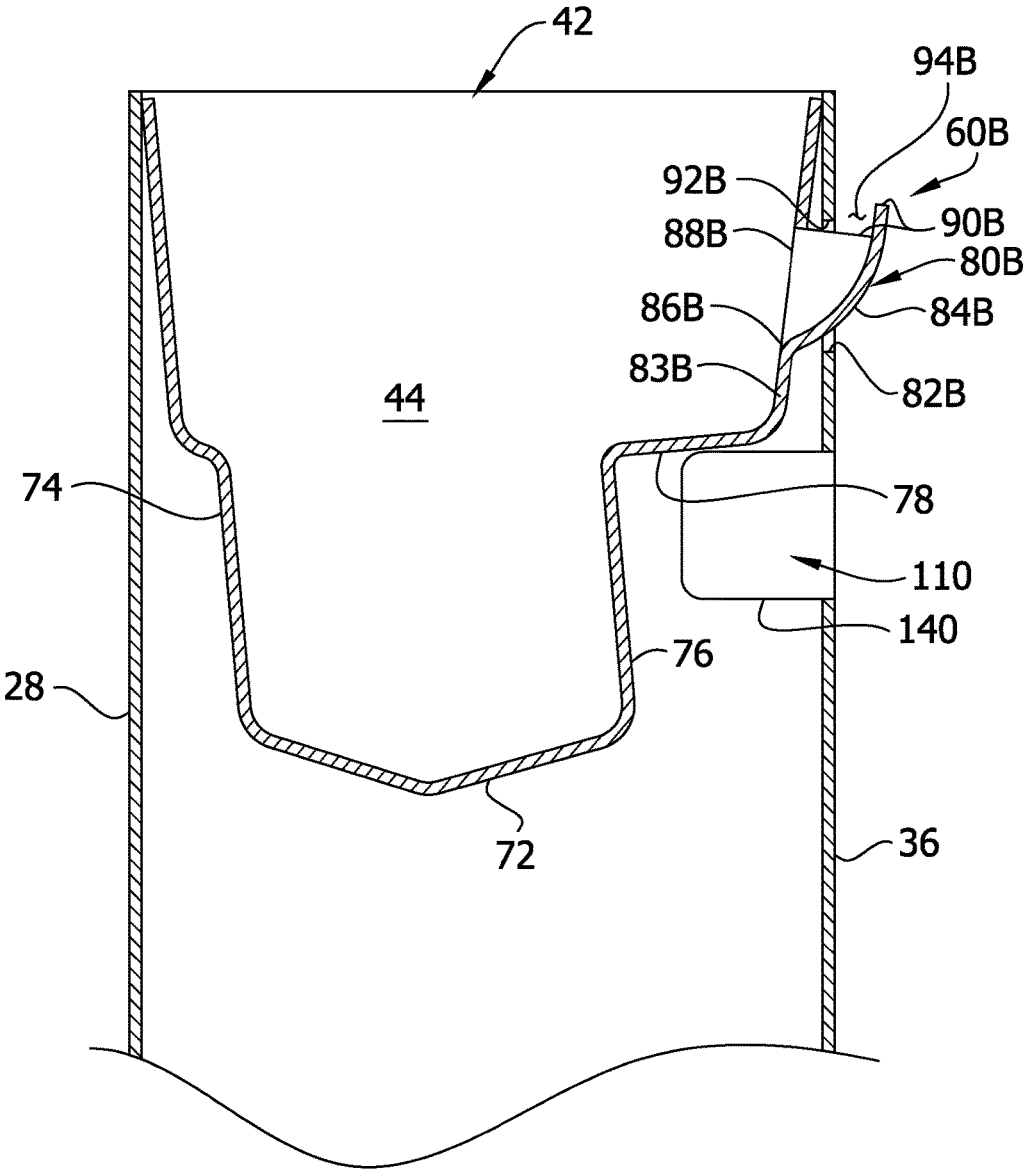
FIG. 4 is an enlarged vertical section taken in the plane of line 4-4 of FIG. 2.
Figure 8:
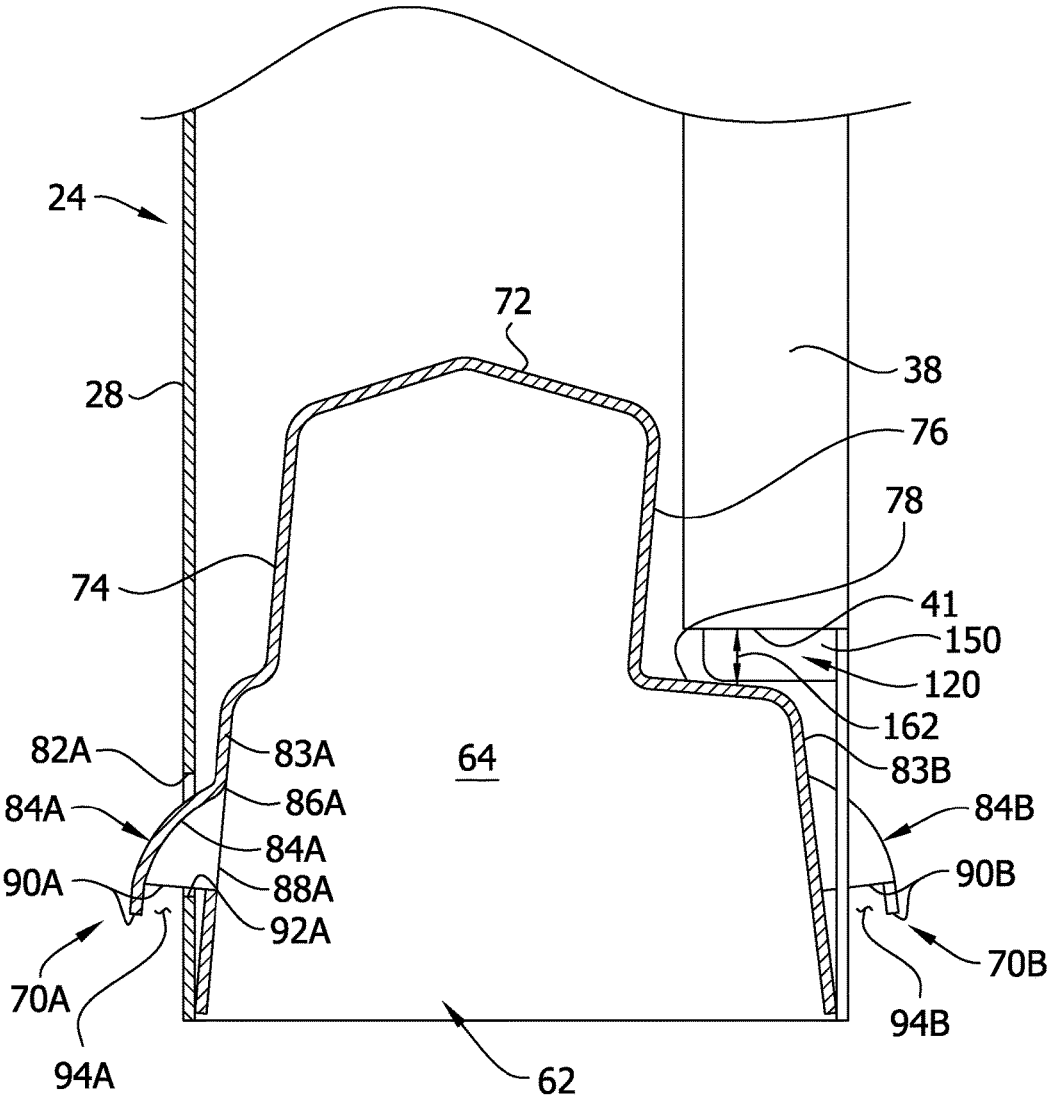
FIG. 8 is an enlarged vertical section taken in the plane of line 8-8 of FIG. 1, but with an end seal removed from the end cap for clarity.

Desirably, the end caps 42, 62 are also formed (e.g., stamped) from sheet metal or other suitable material. As best illustrated in FIGS. 4 and 8, each end cap 42, 62 has the shape of a channel comprising a base wall 72 and first and second opposite side walls 74, 76 extending from the base wall. The walls 72, 74, 76 define the respective cavity 44, 64 for receiving the respective end seal 46, 66. The second side wall 76 of each end cap 42, 62 is formed with a generally horizontal shoulder 78.

Referring to FIGS. 1-4, the first set of one or more louver connections 60 connecting the first (upper) end cap 42 to the first panel member 22 comprises at least one and desirably more than one louver connection 60A between the first side wall 74 of the first end cap 42 and the web 28 of the first panel member, and at least one and desirably more than one louver connection 60B between the second side wall 76 of the first end cap and the in-turned lips 36 of the first panel member. Each louver connection 60A comprises a louver, generally designated 80A, on the first end cap 42 projecting outward through a louver opening 82A in the side wall 74 of the first panel member 22 (see FIG. 6). Similarly, each louver connection 60B comprises a louver, generally designated 80B, on the first end cap 42 projecting outward through a louver opening 82B in the in-turned lip 36 of the first panel member 22 (see FIG. 4).

Figure 3:
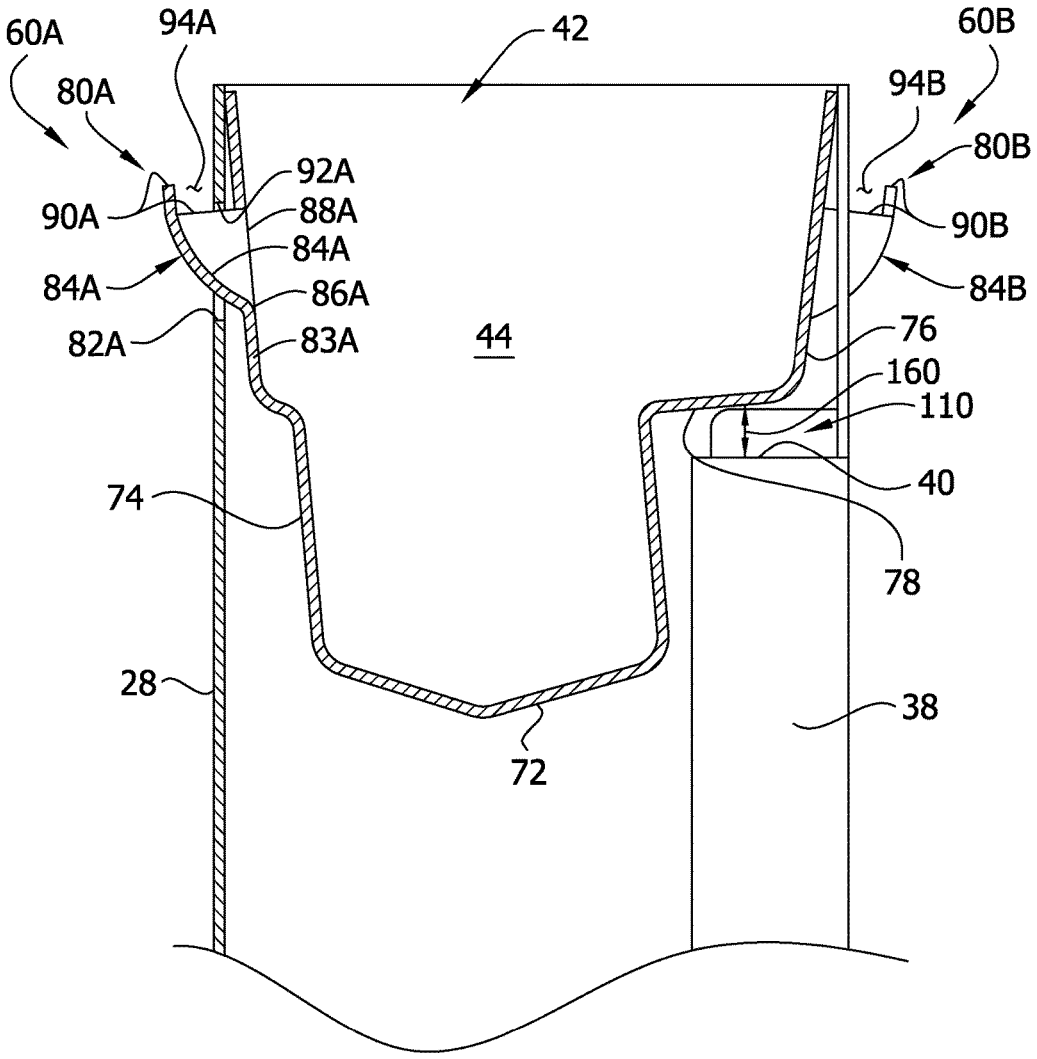
FIG. 3 is an enlarged vertical section taken in the plane of line 3-3 of FIG. 2.

Referring to FIG. 3, the louver 80A of each louver connection 60A is upset or struck from a first region 83A of the end cap 42 (e.g., a planar region of the first side wall 74). The louver 80A comprises a louver body 84A having a base edge 86A integrally joined to the region 83A, opposite sides edges 88A integrally joined to the region 83A, and a free edge 90A opposite the base edge 86A integrally joined to respective opposite side edges 88A of the louver body. The free edge 90A projects outward from the first region 83A for engagement by an opposing edge 92A of the louver opening 82A in the first panel member 22. Desirably, the free edge 90A is configured to define a slot 94A for receiving the edge 92A of the louver opening 84A so that the edge 92A is held captive in the slot 94A in a seated position against the free upper edge 90A of the louver body 84A. In the embodiment of FIG. 3, opposite upper end portions of louver body 84A are recessed (e.g., cut away) such that the free upper edge 90A has depressed substantially straight opposite end segments and an elevated middle segment that combine to define the slot 94A. The edge 92A of the louver opening 84A seats against the depressed end segments.

Similarly, as illustrated best in FIG. 4, the louver 80B of each louver connection 60B is upset or struck from a second region 83B of the end cap 42 (e.g., a planar region of the second side wall 76). The louver 80B comprises a louver body 84B having a base edge 86B integrally joined to the region 83B, opposite sides edges 88B integrally joined to the region 83B, and a free edge 90B opposite the base edge having opposite ends integrally joined to respective opposite side edges 88B of the louver. The free edge 90B projects outward from the second region 83B for engagement by an opposing edge 92B of the corresponding louver opening 82B in the second panel member 22. Desirably, the free edge 90B is recessed to define a slot 94B for receiving the edge 92B of the louver opening 84B so that the edge 92B is held captive in the slot 94B in a seated position against the free upper edge 90B of the louver body 84B. In the embodiment of FIG. 4, opposite upper end portions of louver body 84B are recessed (e.g., cut away) such that the free upper edge 90B has depressed substantially straight opposite end segments and an elevated middle segment that combine to define the slot 94B. The edge 92B of the louver opening 84B seats against the depressed end segments.

The louver connections 60A, 60B hold the first end cap 42 in a stable position against movement relative to the first panel member 22 when the aforesaid extending force is applied to the first end cap 42. Desirably, the reception of the edges 92A, 92B of the louver openings 82A, 82B in respective slots 94A, 94B, minimizes rotation (roll) of the end cap 42 relative to the respective panel member 22.

The louver connections 70A, 70B between the lower end cap 62 and the lower panel member 24 are configured in the same way as the louver connections 60A, 60B.

Referring to FIGS. 1 and 8, the second set of one or more louver connections 70 connecting the second (lower) end cap 62 to the second panel member 24 comprises at least one louver connection 70A between the first side wall 74 of the second end cap 62 and the web 28 of the second panel member, and at least one louver connection 70B between the second side wall 76 of the second end cap and the in-turned lips 36 of the second panel member. The louver connections 70A, 70B are constructed in the same manner as louver connections 60A and 60B, respectively, and corresponding elements of the connections are hereinafter referred to by corresponding reference numbers.

The louver connections 60, 70 described above comprise louvers on respective end caps 42, 62 projecting outward through louver openings in respective panel members 22, 24. However, it will be understood that this arrangement could be reversed. That is, the louvers could be on respective panel members 22, 24 and project inward through louver openings in respective end caps 42, 62.

Figure 6:
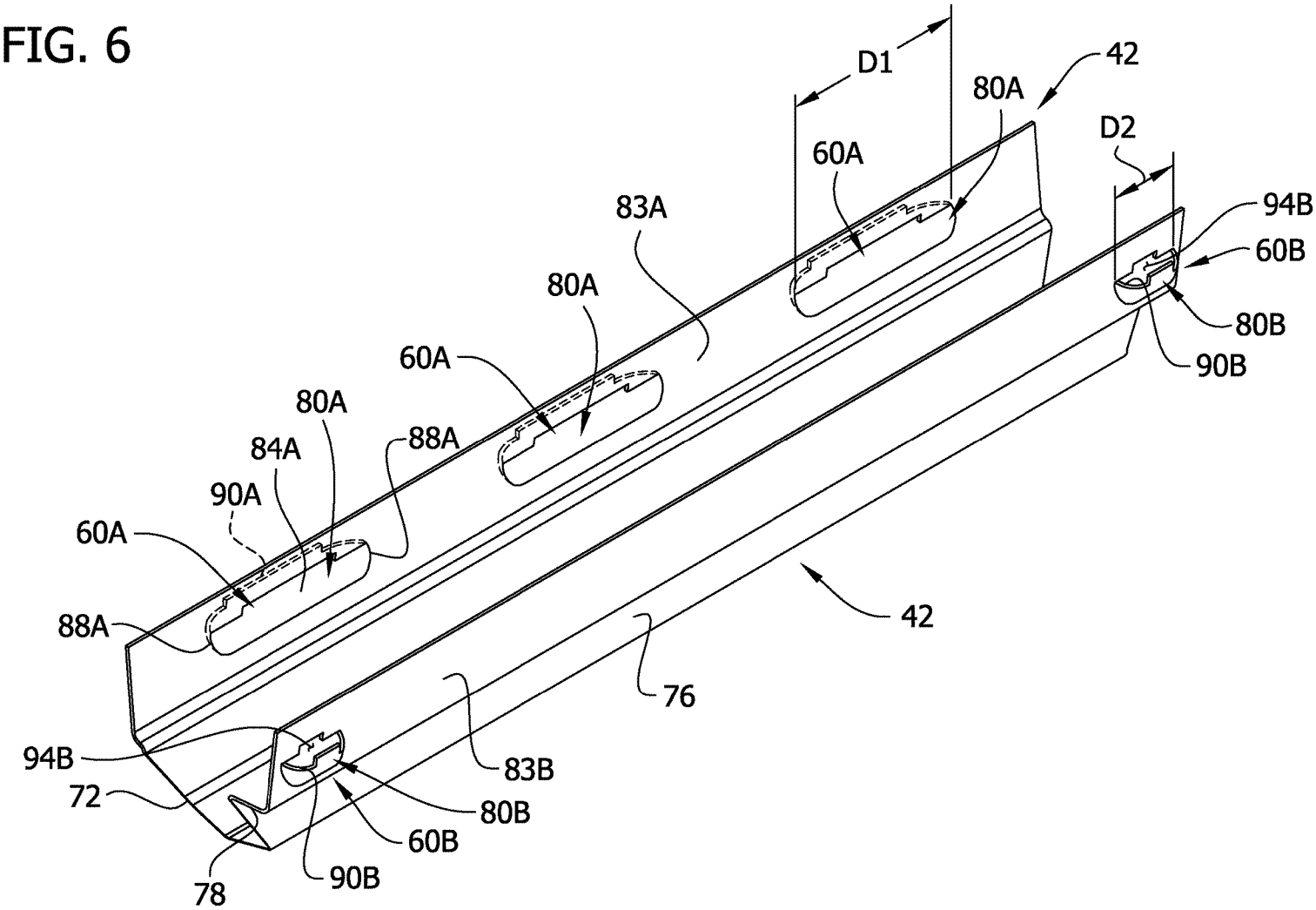
FIG. 6 is a perspective of an upper end cap of the stopping panel.
Figure 7:
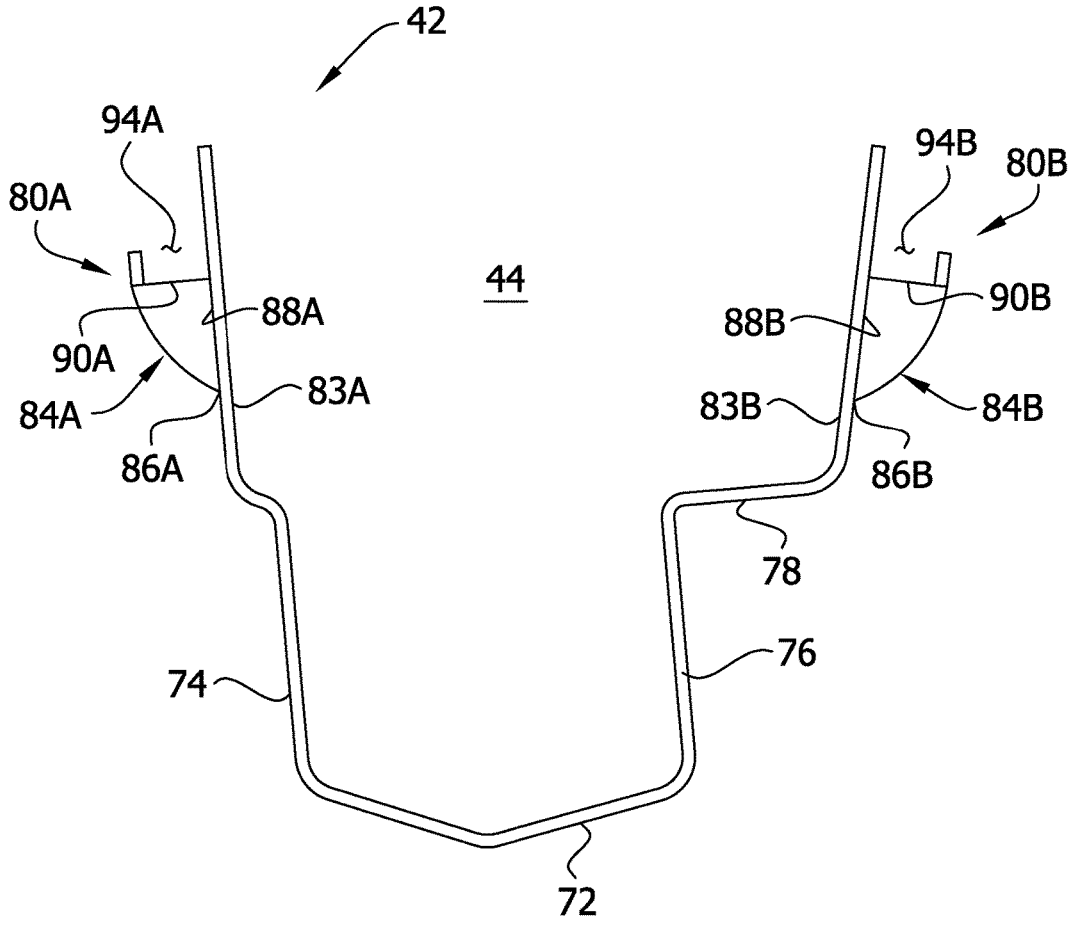
FIG. 7 is a left end elevation of the upper end cap of FIG. 6.

The number of louver connections 60A, 60B, 70A, 70B will vary depending on strength needed to maintain the attachment between the end caps 42, 62, and respective panel members 22, 24 when forces F1, F2 are applied to the end caps (as by the aforementioned jack) to extend the panel members relative to one another to bring the end seals 46, 66 into sealing engagement with opposing surfaces (e.g., roof and floor) of a mine passage. Also, the size and configuration of the louver connections 60A, 60B, 70A, and 70B can vary as needed or desired. For example, the length of the louvers 80A, 80B can vary from one louver connection to another louver connection. By way of example, as shown in FIG. 6, the louvers 80A of the louver connections 60A may have a relatively long side-to-side dimension D1 (e.g., 1.75 in), while the louvers 80B of louver connections 60B may have a shorter side-to-side dimension D2 (e.g., 0.75 in).

It will be observed that the first set of one or more louver connections 60A, 60B may not be effective in holding the first end cap 42 against movement relative to the first panel member 22 when a contracting force F3 (FIG. 1) is applied to the first end cap tending to telescopically contract the first panel member 22 relative to the second panel member 24 in a second (downward) direction along the axis A1 opposite a first (upward) direction. Similarly, the second set of one or more louver connections 70A, 70B may not be effective in holding the second end cap 62 against movement relative to the second panel member 24 when a contracting force F4 (FIG. 1) is applied to the second end cap tending to telescopically contract the second panel member 24 relative to the first panel member 22 in a second (upward) direction along the axis A1 opposite the aforesaid first (downward) direction. Contracting forces F3 and F4 may be applied to one or both panel members 22, 24 during convergence of the roof and floor of the mine after installation, and/or during the process of assembling, shipping, and installing the panel 22, and/or during recovery of the panel for re-use.

Referring again to FIG. 1, at least one stop, generally designated 110, is provided on the first panel member 22 configured for engagement by the first end cap 42 to limit telescopic movement of the first end cap relative to the first panel member when a contracting (downward) force F3 is applied to the first end cap. Two such stops 110 are shown in FIG. 1. Similarly, at least one stop, generally designated 120, is provided on the second panel member 24 configured for engagement by the second end cap 62 to limit telescopic movement of the second end cap relative to the second panel member 24 when a contracting (upward) force F4 is applied to the second end cap. Two such stops 120 are shown in FIG. 1.

Figure 5:
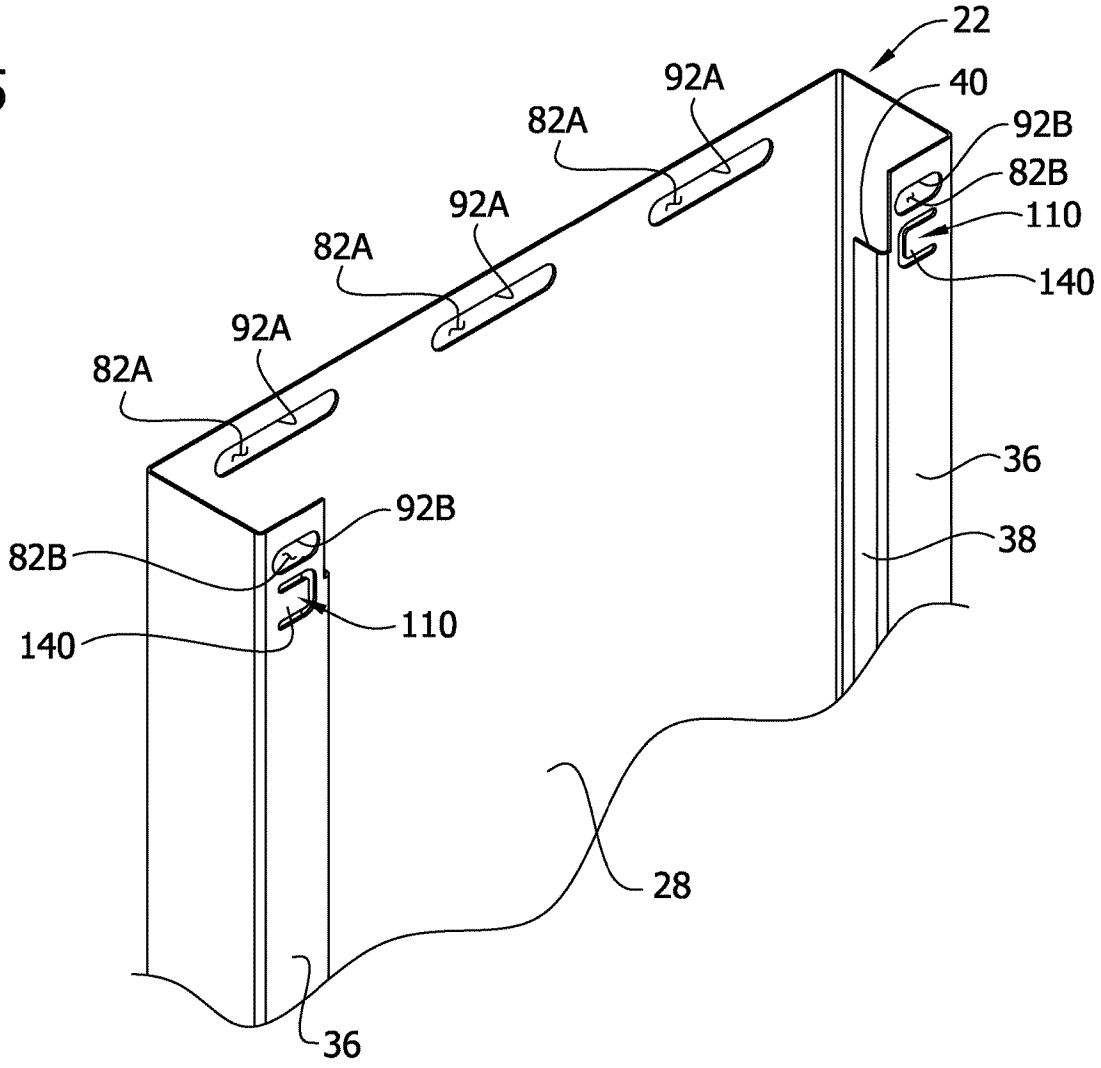
FIG. 5 is a partial perspective of an upper panel member of the stopping panel of FIG. 1.

Referring to FIGS. 1, 4, and 5, each stop 110 comprises a tab 140. Desirably, each tab 140 is formed as an integral part of the first panel member 22. The tabs 140 can be bent from the initial positions shown in FIG. 5 to the stop positions shown in FIGS. 1 and 4 in which they are positioned for engagement by the shoulder 78 of the first end cap 42 to limit telescopic movement (downward displacement) of the first end cap relative to the first panel member 22 when the contracting (downward) force F3 is applied to the first end cap. By limiting such downward displacement, the louvers 80A, 80B are retained in respective louver openings 82A, 82B when the upper end cap 42 is subjected to the downward contracting force F3.

Similarly, as shown in FIGS. 1 and 8, each stop 120 comprises a tab 150 formed as an integral part of the second panel member 24. The tabs 140 can be bent from a position generally co-planar with flanges 36 to the stop position shown in FIGS. 1 and 8 for engagement by the second end cap 62 to limit telescopic movement (upward displacement) of the second end cap relative to the second panel member 24 when the contracting (upward) force F4 is applied to the lower end cap. By limiting such upward displacement, the louvers of the louver connections 70A, 70B are retained in respective louver openings of the connections 70A, 70B when the panel 20 is subjected to the upward contracting force F4.

The components of the panel 20 are easy to assemble. In this regard, the upper end cap 42 is assembled with the upper panel member 22 by moving the end cap down into a position between the flanges 30 of the panel member, as illustrated in FIG. 1. During this downward movement, the opposing walls 74, 76 of the end cap 42 and/or the sheet material of the upper panel member 22 resiliently deform (deflect) until the louvers 80A, 80B of the louver connections 60A, 60B are able to spring into respective louver openings 82A, 82B and thereby snap fasten the end cap to the upper panel member. Thus, the louver connections 60A, 60B may be considered to be mechanical snap fastening connections connecting the upper end cap 42 to the upper panel member 22. Similarly, the lower end cap 62 is assembled with the lower panel member 24 in substantially the same way, and the louver connections 70A, 70B secure the lower end to the lower panel member. After assembly of the end caps and the panel members, the tabs 140 of the stops 110 are bent inward from the position of FIG. 5 to the position of FIG. 2. The upper and lower end seals 46, 66 are placed in respective cavities 44, 64 of the upper and lower end caps 42, 62 to complete the assembly.

Desirably, when the panel 20 is finally assembled, a gap 160 exists between the upper terminal edges 40 and the shoulder 78 of the upper end cap 42 (see FIG. 3). During assembly, this gap 160 allows the upper end cap 42 to be moved downward between the flanges 30 of the upper panel member 22 a distance sufficient to permit lateral movement of the louvers 80A, 80B into respective louver openings 82A, 82B, and then moved up a short distance so that the upper edges 92A, 92B of the louver openings are located in the louver slots 94A, 94B. Similarly, when the panel 22 is finally assembled, a gap 162 exists between the lower terminal edges 41 and the shoulder 78 of the lower end cap 42 (see FIG. 8). During assembly, this gap 162 allows the lower end cap 62 to be moved upward between the flanges 30 of the lower panel member 24 a distance sufficient to permit lateral movement of the louvers of the connections 70A, 70B into respective louver openings of the connections 70A, 70B, and then moved down a short distance so that the upper edges of the louver openings are located in the louver slots 94A, 94B of the connections 70A, 70B.

If the gaps 160, 162 are sufficiently small, the engagement of the end caps 42, 62 with respective terminal edges 40, 41 of the panel members 22, 24 may be effective in limiting displacement of the end caps relative respective panel members 22, 24 when the panel 20 is subjected to contracting forces (e.g., F3, F4) tending to collapse the panel 20. Desirably, the end caps 42, 62, or the edge margins 38 of the panel members 22, 24, or both, are resiliently deformable such that the gaps 160, 162 expand to a size large enough to allow the louvers to spring into respective louver openings during assembly of the end caps and the panel members, and then contract to a size small enough to inhibit movement of the louvers out of respective louver openings after assembly is complete. In one embodiment, the extent of expansion and contraction of each gap 160, 162 is in the range of 0.040-0.060 in.

FIGS. 9-14 illustrate a second embodiment of a mine stopping panel of this invention, generally designated 220. The panel is similar to the stopping panel 20 of the first embodiment, and corresponding elements are designated by corresponding reference numbers increased by 200. The stopping panel 220 is different from panel 20 in two respects.

Figure 10:
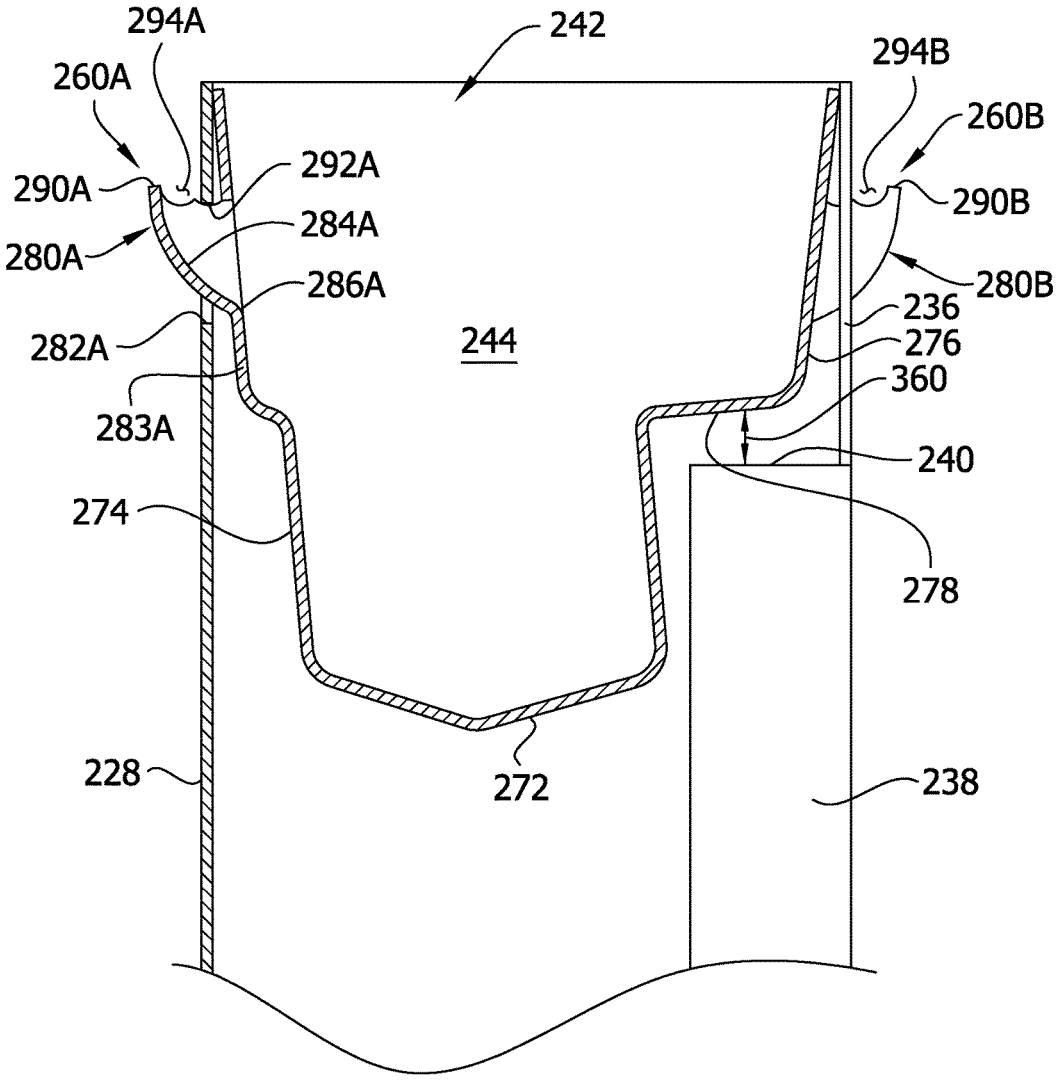
FIG. 10 is an enlarged vertical section taken in the plane of line 10-10 of FIG. 9.
Figure 11:
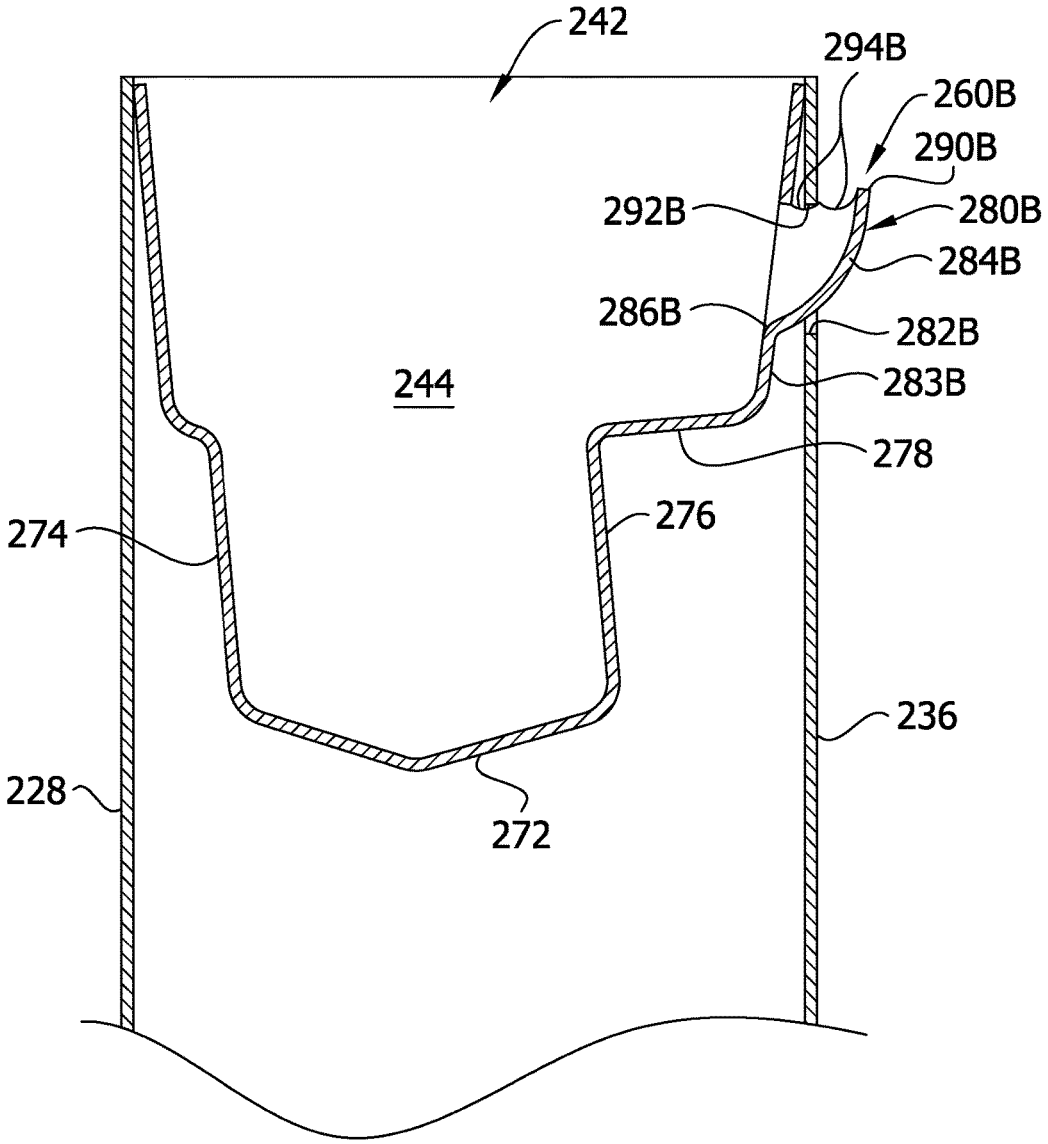
FIG. 11 is an enlarged vertical section taken in the plane of line 11-11 of FIG. 9.
Figure 14:
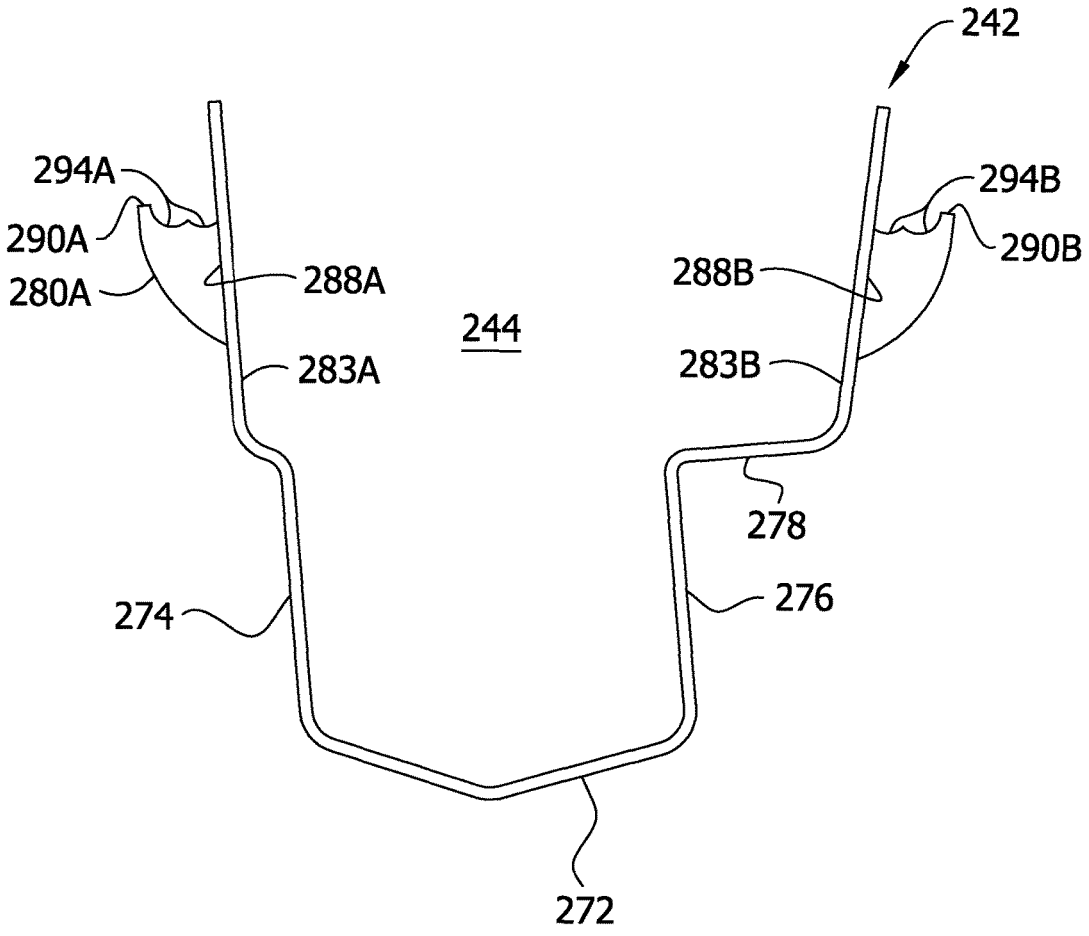
FIG. 14 is a left end elevation of the upper end cap of FIG. 13.

First, the louver connections 260A, 260B have a different configuration. As illustrated in FIGS. 10, 11, and 14, the louver bodies 284A, 284B on the upper end cap 242 have free (upper side) edges 290A, 290B configured to have scalloped recesses or grooves 294A, 294B for receiving the upper edges 292A, 292B of the louver openings 282A, 282B in the panel member 222 (see FIGS. 10 and 11). The reception of the edges 294A, 294B in the grooves 294A, 294B minimizes rotation (roll) of the end cap 242 relative to the panel member 222. The louver connections 270A, 270B between the lower end cap 262 and the lower panel member 224 are configured in the same way (see FIG. 11A).

Figure 9:
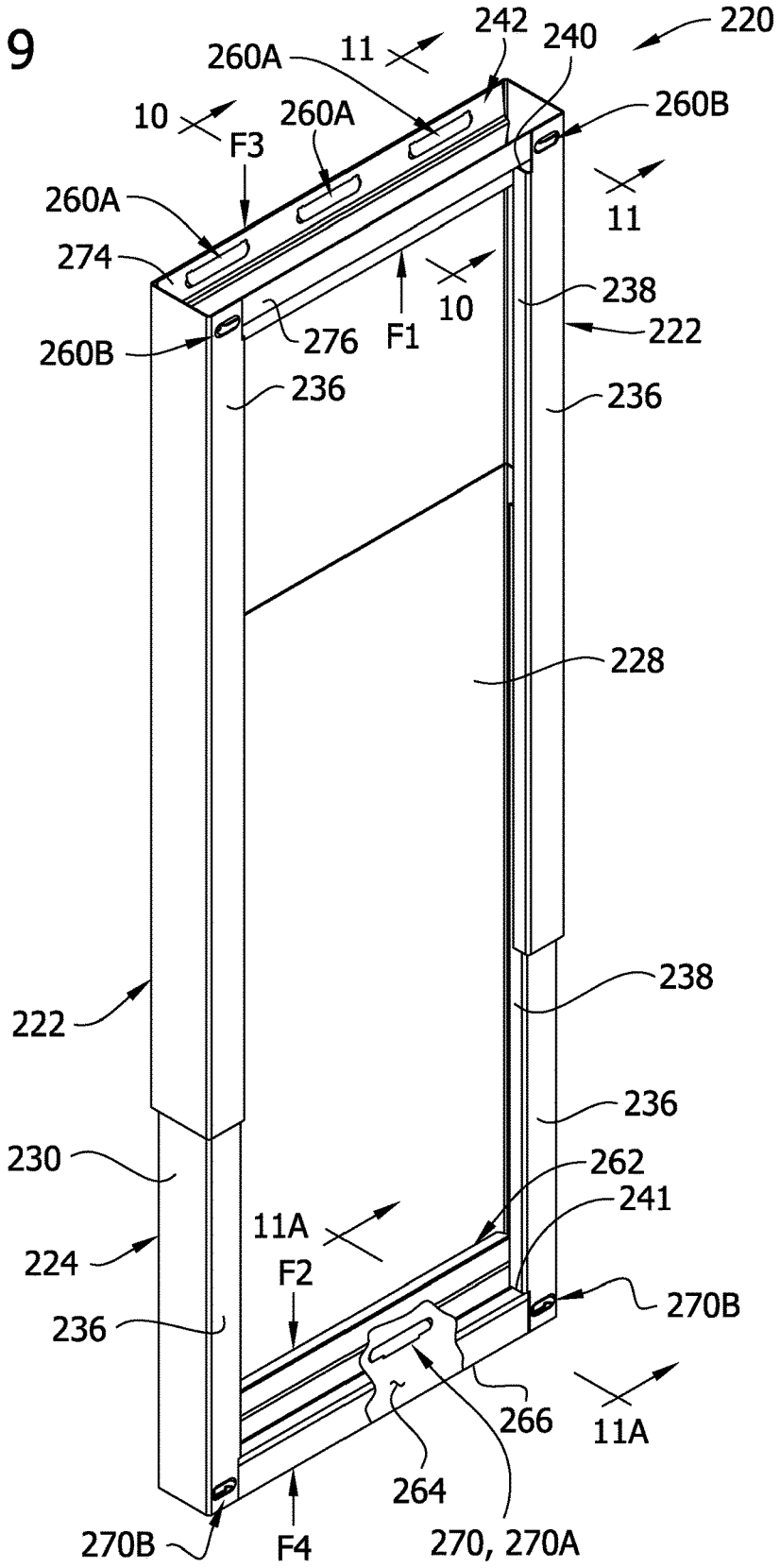
FIG. 9 is a partial perspective of an upper end portion of a second embodiment of a stopping panel having louver connections of an alternative design.

The second difference is the stop arrangement for limiting telescopic movement of the upper end cap 242 relative to the upper panel member 222 when a contracting (downward) force F3 is applied to the upper end cap, and for limiting telescopic movement of the lower end cap (not shown) relative to the lower panel member (not shown) when a contracting (upward) force F4 is applied to the lower end cap. In the stopping panel 220, the folding-tab stops 110 of the first embodiment are eliminated. Instead, as illustrated in FIG. 9, the arrangement is such that the upper end cap 242, e.g., shoulder 278, engages the upper terminal edges 240 of the edge margins 238 of the in-turned lips 236 of the panel member 222 to limit downward telescopic movement (displacement) of the end cap relative to the upper panel member 222 when the contracting (downward) force F3 is applied to the upper end cap. Similarly, the shoulder 278 of the lower end cap engages the lower terminal edges of the edge margins 238 of the in-turned lips 236 of the panel member 222 to limit upward telescopic movement (displacement) of the lower end cap 262 relative to the lower panel member when the contracting (upward) force is applied to the lower end cap.

Desirably, when the panel 220 is finally assembled, a gap 360 exists between the upper terminal edges 240 and the shoulder 278 of the upper end cap 242 (see FIG. 10). During assembly, this gap 360 allows the upper end cap 242 to be moved down into the cavity 244 a distance sufficient to permit lateral movement (e.g., resilient snap action) of the louvers 280A, 280B into respective louver openings 282A, 282B, and then moved up a short distance so that the upper edges of the louver openings are located in the louver slots 294A, 294B. Similarly, when the panel 222 is finally assembled, a gap 362 exists between the lower terminal edges 241 and the shoulder 278 of the lower end cap 242 (see FIG. 11A). During assembly, this gap 362 allows the lower end cap 262 to be moved up into the cavity 264 a distance sufficient to permit lateral movement of the louvers of the connections 270A, 270B into respective louver openings of the connections 270A, 270B, and then moved down a short distance so that the lower edges of the louver openings are located in the louver slots 294A, 294B of the connections 270A, 270B (see FIG. 11A). Desirably, as in the first embodiment, the end caps 242, 262, or the edge margins 238 of the panel members 222, 224, or both, are resiliently deformable such that the gaps 360, 362 expand to a size large enough to allow the louvers to spring into respective louver openings during assembly of the end caps and the panel members, and then contract to a size small enough to inhibit movement of the louvers out of respective louver openings after assembly is complete. In one embodiment, the extent of expansion and contraction of each gap 360, 362 is in the range of 0.040-0.060 in.

Like panel 20, the components of the panel 220 are easy to assemble. In this regard, the upper end cap 242 is assembled with the upper panel member 222 by moving the end cap down into a position between the flanges 230 of the panel member, as illustrated in FIG. 9. During this downward movement, the opposing walls of the 274, 276 of the end caps and/or the sheet material of the upper panel member 22 resiliently deform until the louvers 280A, 280B of the louver connections 260A, 260B are able to spring into respective louver openings 282A, 282B and thereby snap fasten the end cap to the upper panel member. Thus, the louver connections 260A, 260B may be considered to be mechanical snap fastening connections connecting the upper end cap to the upper panel member. Similarly, the lower end cap 262 is assembled with the lower panel members 224 in substantially the same way, and the louver connections 270A, 270B secure the lower end to the lower panel member. After assembly of the end caps and the panel members, the upper and lower end seals 246, 266 are placed in respective cavities 244, 264 of the upper and lower end caps 242, 262.

Figure 11A:
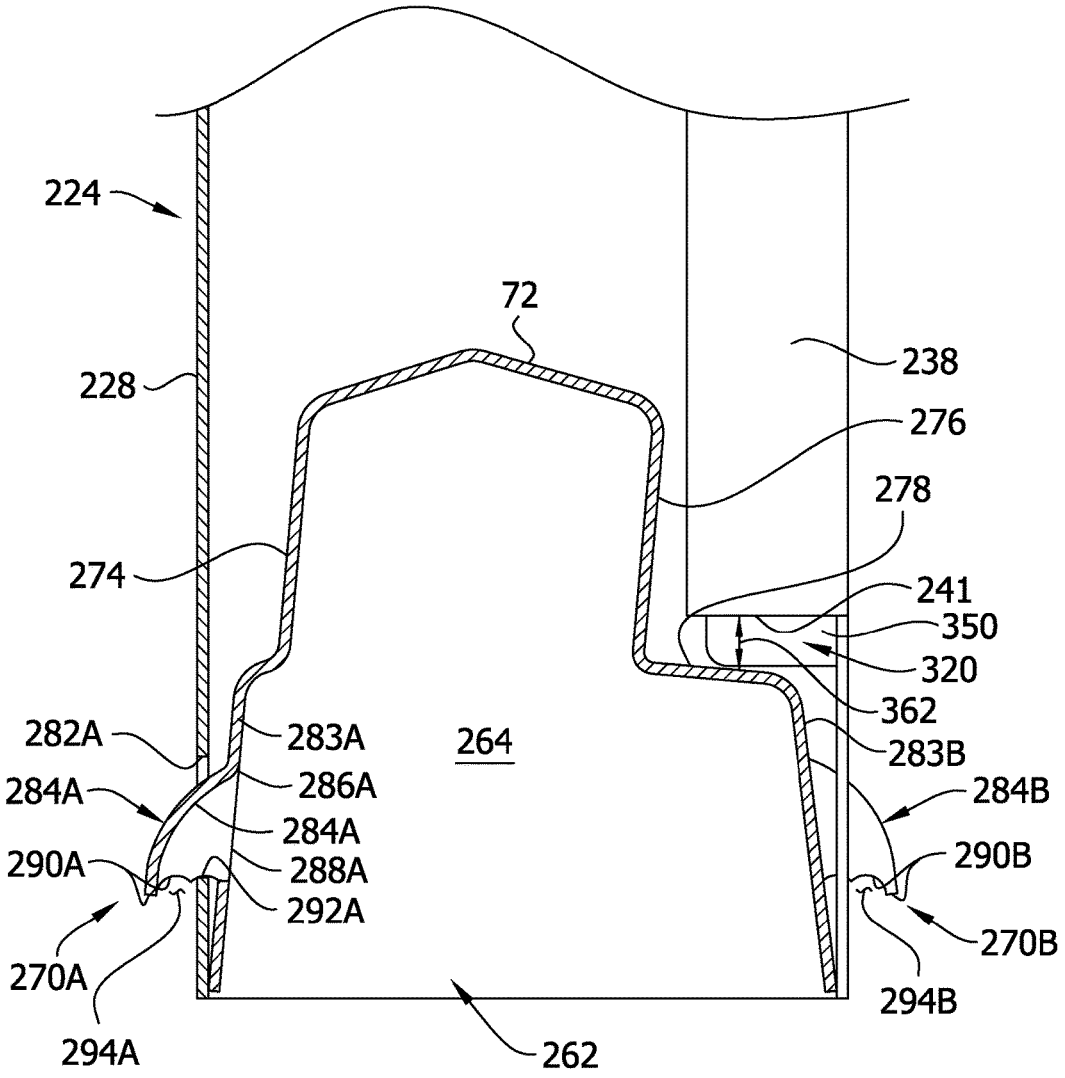
FIG. 11A is an enlarged vertical section taken in the plane of line 11A-11A of FIG. 9.
Figure 12:
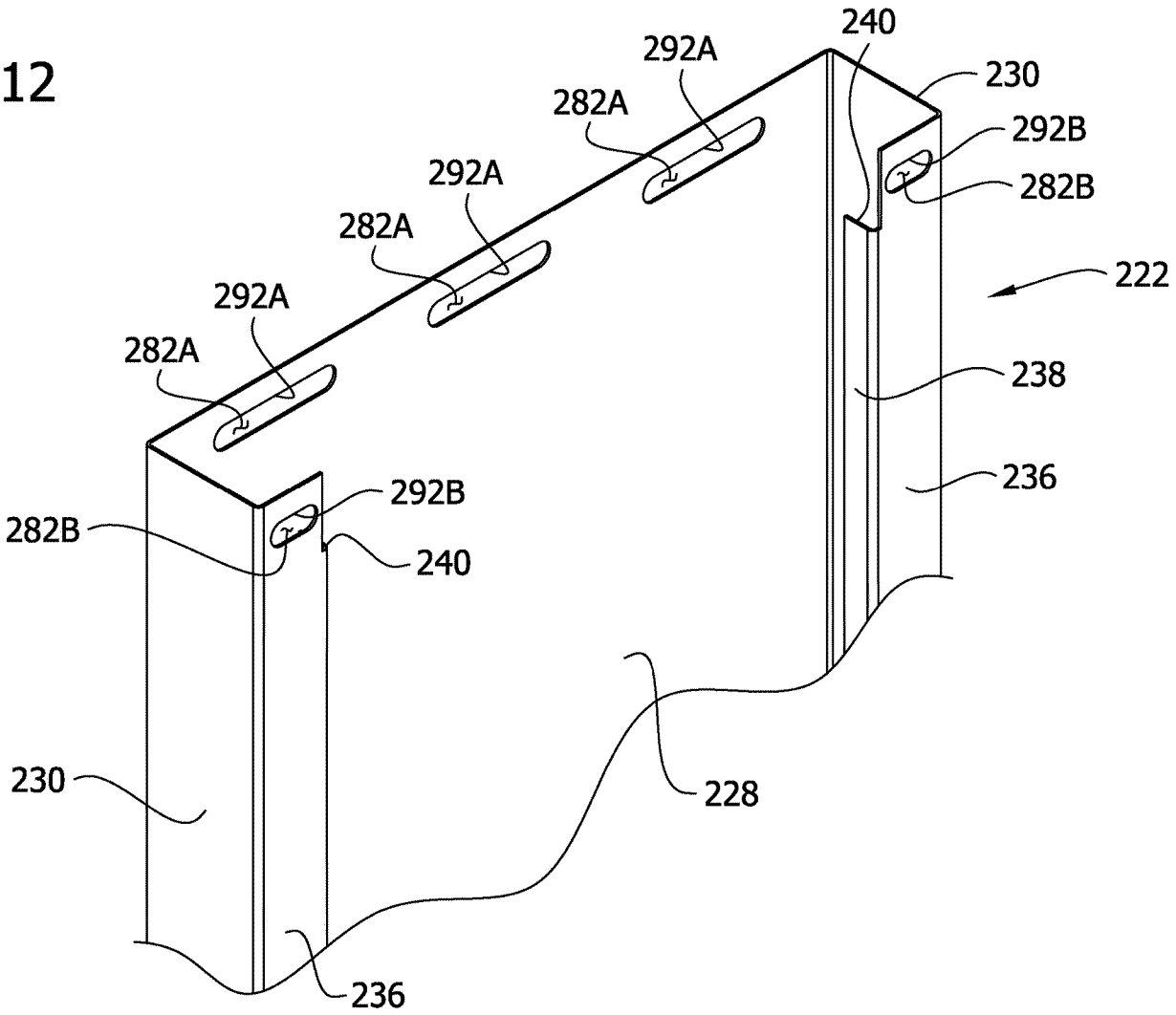
FIG. 12 is a perspective of an upper portion of an upper panel member of the mine stopping panel of FIG. 9.
Figure 13:
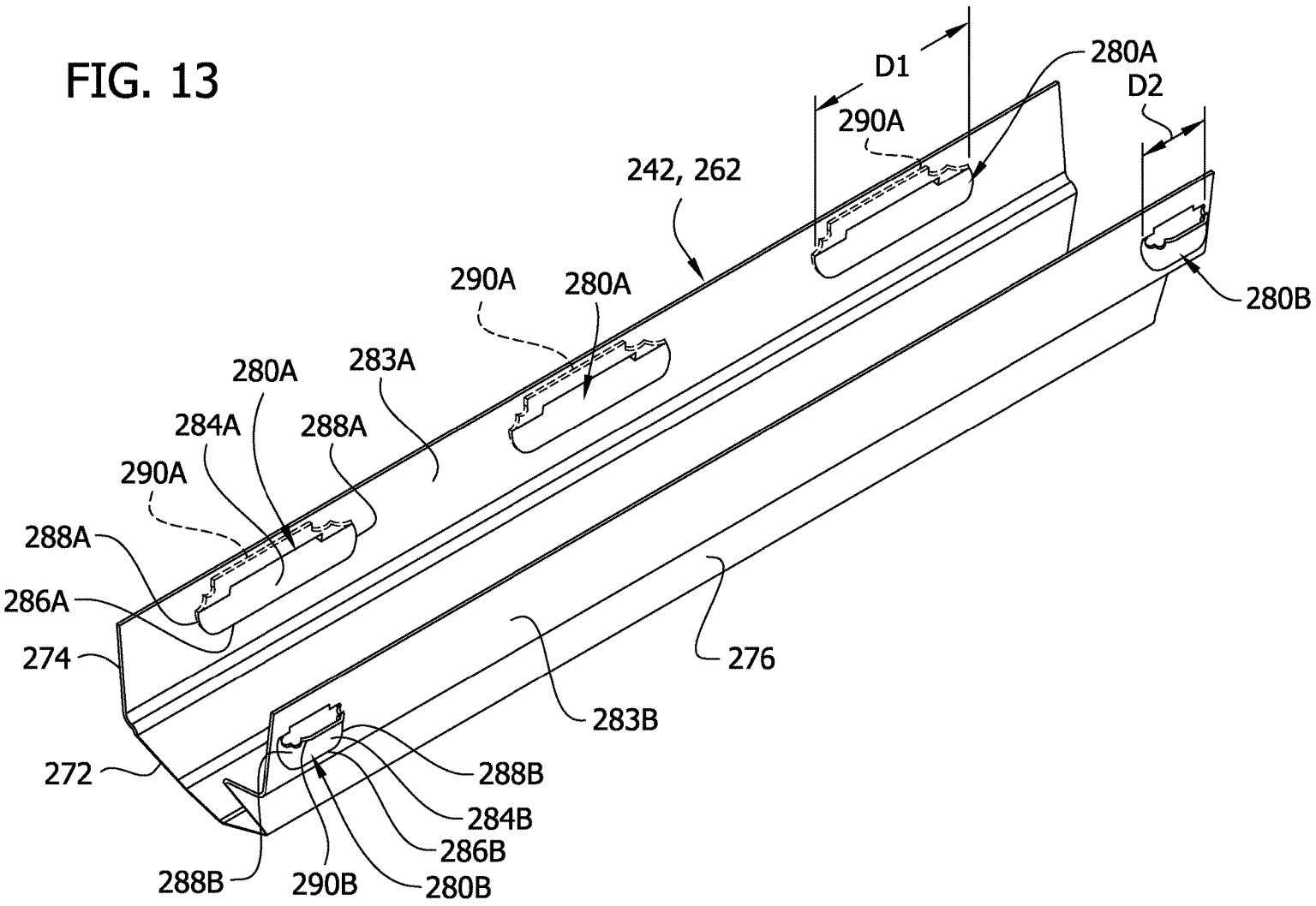
FIG. 13 is a perspective of an upper end cap of the stopping panel of FIG. 9.

Alternatively, the gaps 360, 362 illustrated in FIGS. 10 and 11A can be eliminated so that the upper and lower end caps 242, 262 are in direct contact with respective terminal edges 240, 241 of the edge margins 238 of the in-turned lips 236 of the panel members 222, 224. In this embodiment, each end cap can be assembled with a respective panel member by first hooking the lip louvers of the end cap (e.g., louvers 280B in FIGS. 10 and 11) into respective lip louver openings of the panel member (e.g., louver openings 282B) and then rolling the end cap about its long axis to move the web louvers (e.g., louvers 280A) of the end cap into respective web louver openings of the panel member (e.g., louver openings 282A in FIG. 10).

FIGS. 15-22 illustrate a third embodiment of a mine stopping panel of this invention, generally designated 20'. The panel is similar to the stopping panel 20 of the first embodiment, and corresponding elements are designated by corresponding reference numbers with an added prime designator (').

The panel 20' comprises first (upper) and second (lower) elongate panel members 22', 24' of channel shape. Each panel member 22', 24' has a web 28', first and second flanges 30' at opposite sides of the web, and in-turned lips 36' at outer edges of the flanges. In the illustrated embodiment, the in-turned lips have edge margins 38' bent back toward the web 28' in a direction generally parallel to the flanges 30'. The edge margins 38' of the upper panel member 22' have upper end edges 40' terminating short of the upper end of the panel member 22'. Similarly, the edge margins of the lower panel member 24' have lower end edges 41' terminating short of the lower end of the panel member 24'. The first and second panel members have a telescoping sliding fit one inside the other along an axis A1 extending lengthwise of the panel members 22', 24'. Desirably, the panel members 22', 24' are formed from sheet metal or other suitable material.

Figure 15:
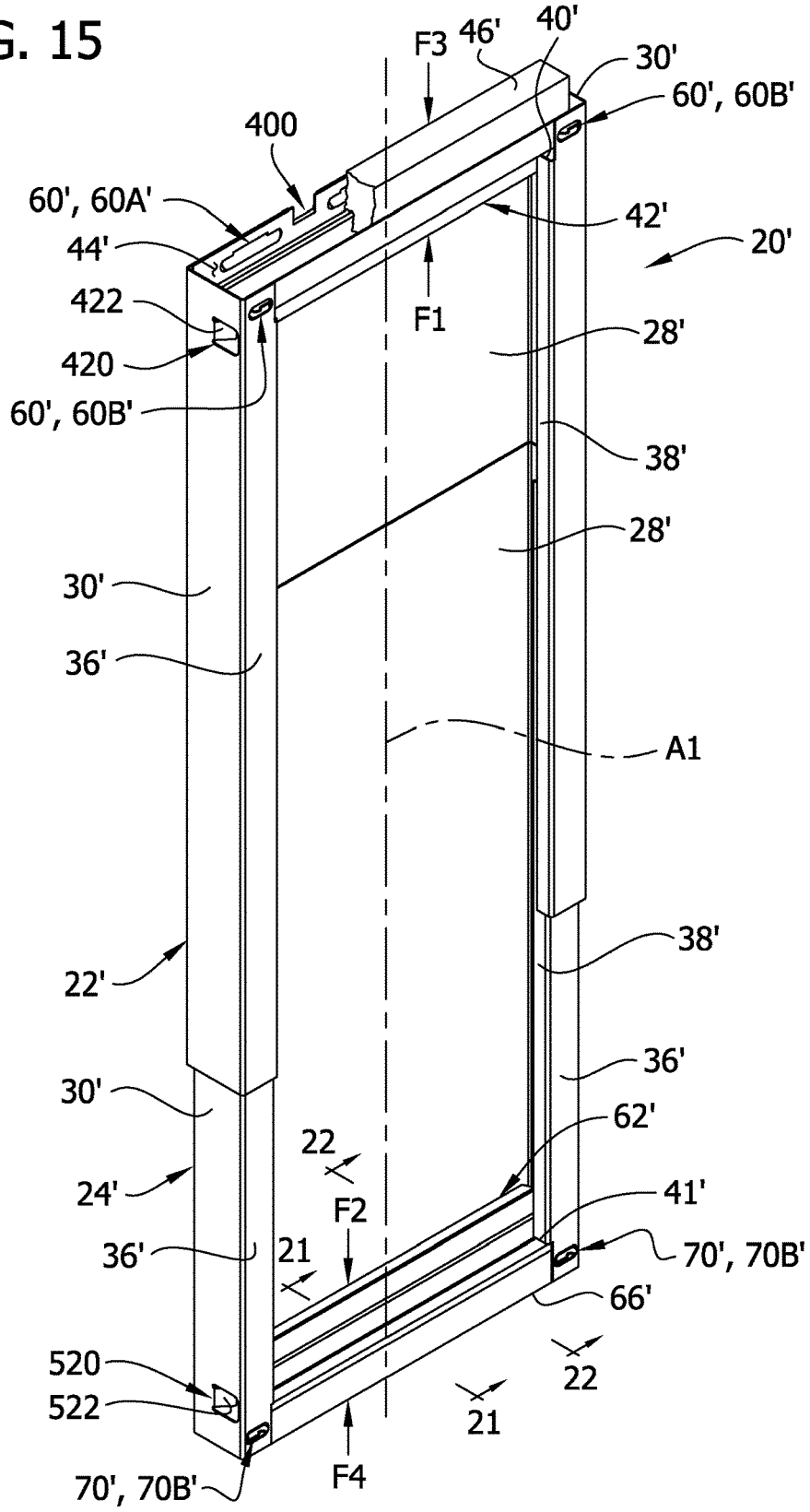
FIG. 15 is a perspective of a second embodiment of a mine stopping panel of this invention in which end caps of the panel are attached to respective panel members by louver connections, and the panel is equipped with certain reverse loading features.
Figure 18:
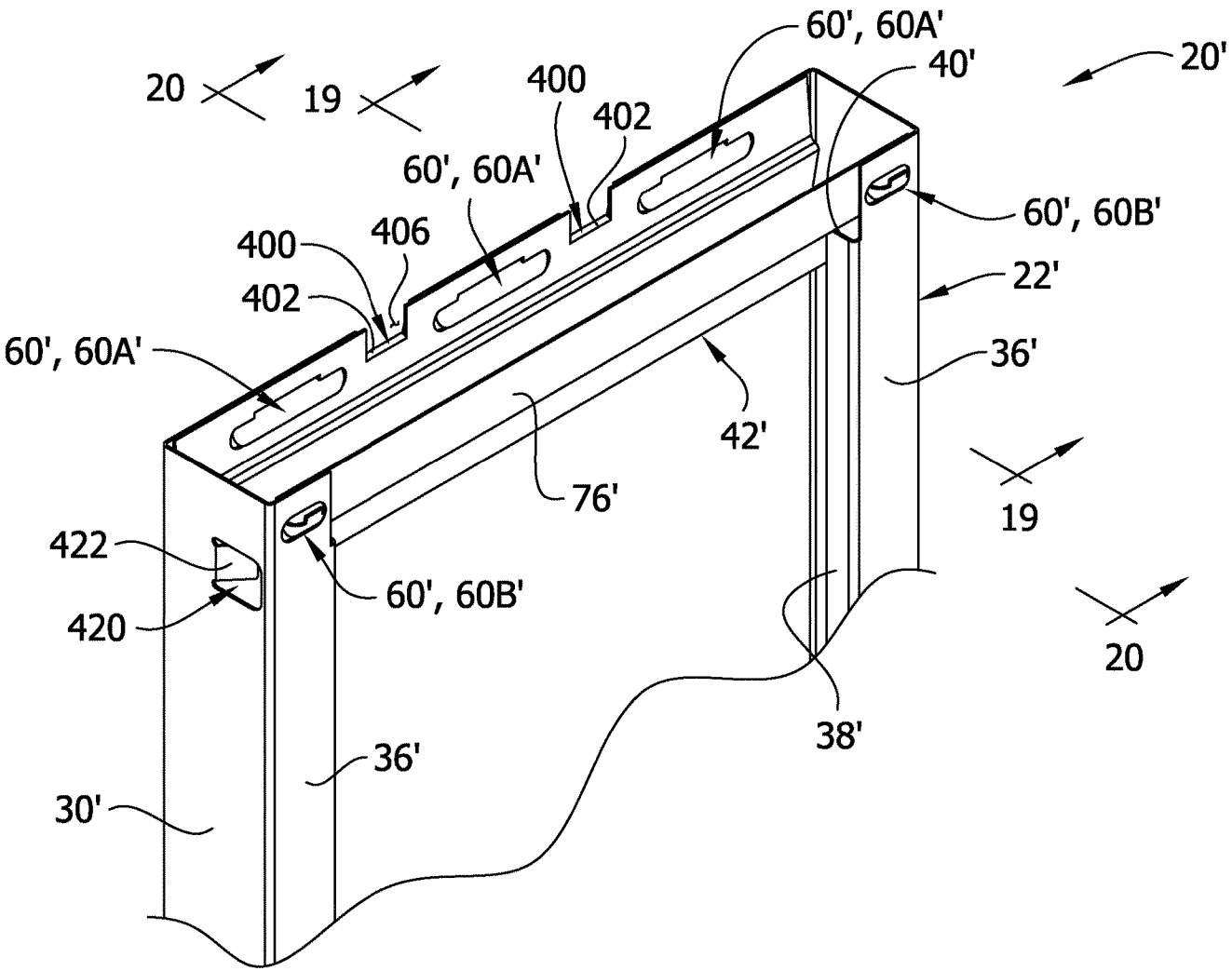
FIG. 18 is an enlarged upper end portion of the stopping panel of FIG. 15.

As illustrated in FIGS. 15 and 18, an elongate first end cap, generally designated 42', extends between the first and second flanges 30' of the first (upper) panel member 22' on an inside surface of the web 28 of the first panel member at an upper end of the panel member. In general, the first end cap 42' has a length sized for a relatively loose fit between the flanges 30' of the upper panel member 22', and a width at its top sized for a relatively snug fit between the web 28' of the panel member and the in-turned lips 36' of the panel member 22'. (The relatively loose fit of the end cap 42' between the flanges 30' provides room for the panel member 22' to contract horizontally in the event of pillar expansion. That is, the flat web 28' of the panel member can buckle outward. The relatively snug fit between the web 28' of the panel member and the in-turned lips 36' of the panel member 22' provides the snap fastening action of the louver connections 60' described below.) The first end cap 42' defines a first cavity 44' for receiving a first end seal 46' for sealing engagement with a first mine surface, such as the roof of a mine passage. A first set of one or more louver connections, each generally indicated at 60', between the first panel member 22' and the first end cap 42' hold the first end cap against movement relative to the first panel member 22' when an extending force F1 (FIG. 15) is applied to the first end cap tending to telescopically extend the first panel member relative to the second panel member 24' in a first direction (typically vertically upward) along the axis A1 of the panel members to bring the first end seal 46' into pressure engagement with the first mine surface (e.g., the roof of a mine passage). A jack may be used to generate the extending force, as described in co-assigned U.S. Pat. No. 7,267,505. Other extension mechanisms may also be used.

Figure 21:
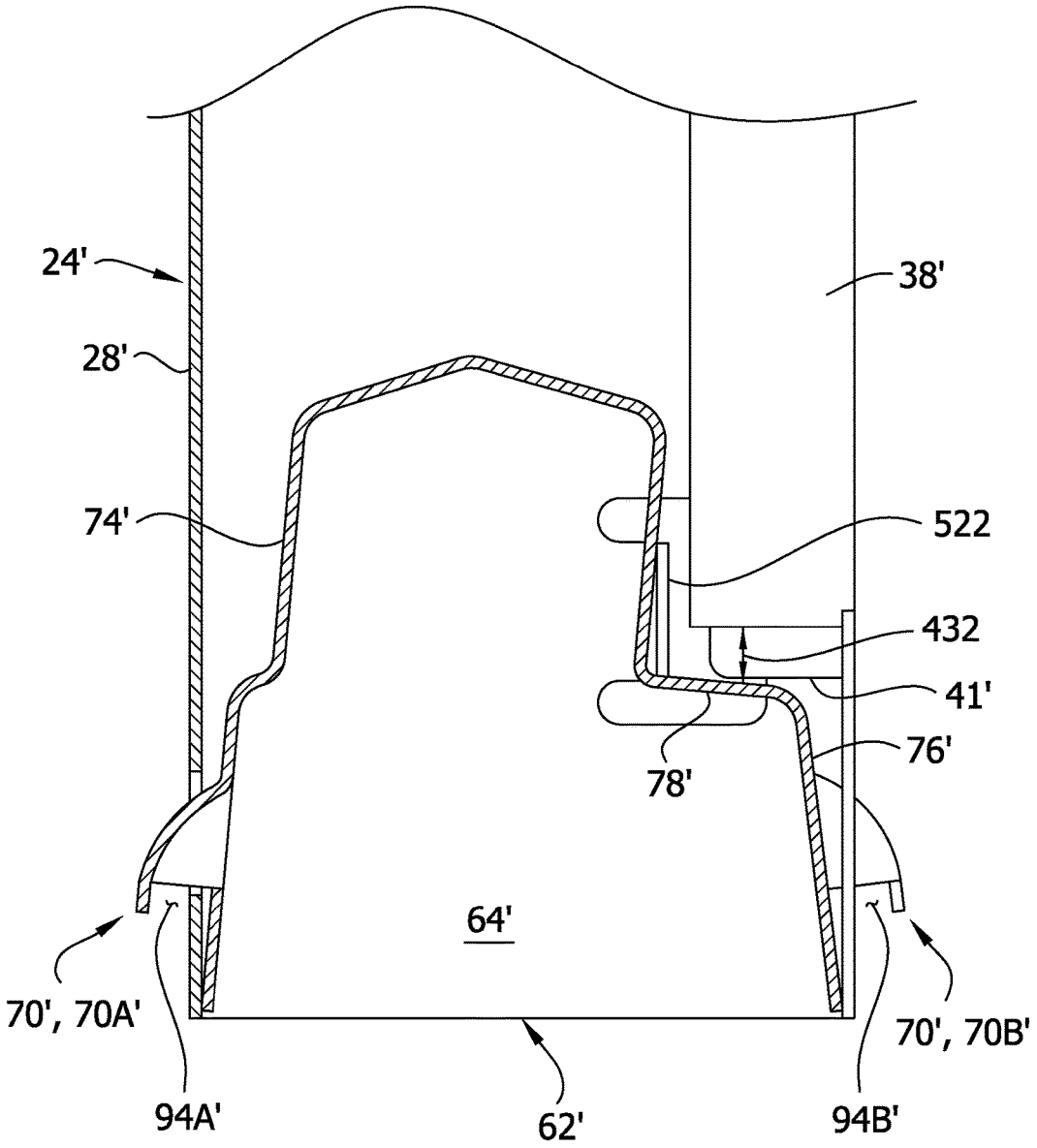
FIG. 21 is an enlarged vertical section taken in the plane of line 21-21 of FIG. 15 illustrating louver connections of the lower panel member and the lower end cap of the stopping panel.

Similarly, an elongate second end cap, generally designated 62', extends between the first and second flanges 30' of the second panel member 24' on an inside surface of the web 28' of the second panel member at a lower end of the panel 20' (see FIGS. 15 and 21). In general, the second end cap 62' has a length sized for a relatively loose fit between the flanges 30' of the lower panel member 24', and a width at its bottom sized for a relatively snug fit between the web 28' of the panel member 24' and the in-turned lips 36' of the panel member. (The relatively loose fit of the end cap 62' between the flanges 30' provides room for the panel member 24' to contract horizontally in the event of pillar expansion. That is, the flat web 28' of the panel member can buckle outward. The relatively snug fit between the web 28' of the panel member 24' and the in-turned lips 36' of the panel member 22' provides the snap fastening action of the louver connections 70' described below.) The second end cap 62' defines a second cavity 64' for receiving a second end seal 66' for sealing engagement with a second mine surface, such as the floor of a mine passage. A second set of one or more louver connections, each generally indicated at 70', between the second panel member 22' and the second end cap 62' hold the second end cap against movement relative to the second panel member 22' when an extending force F2 (FIG. 15) is applied to the second end cap tending to telescopically extend the second panel member 24 relative to the first panel member 22' in a second direction (typically vertically downward) along the axis A1 of the panel members to bring the second end seal 66' into pressure engagement with the second mine surface (e.g., the floor of a mine passage). As noted above, the jack described in co-assigned U.S. Pat. No. 7,267,505 may be used to apply the extending force. Alternatively, other extension mechanisms may be used.

Figure 17:
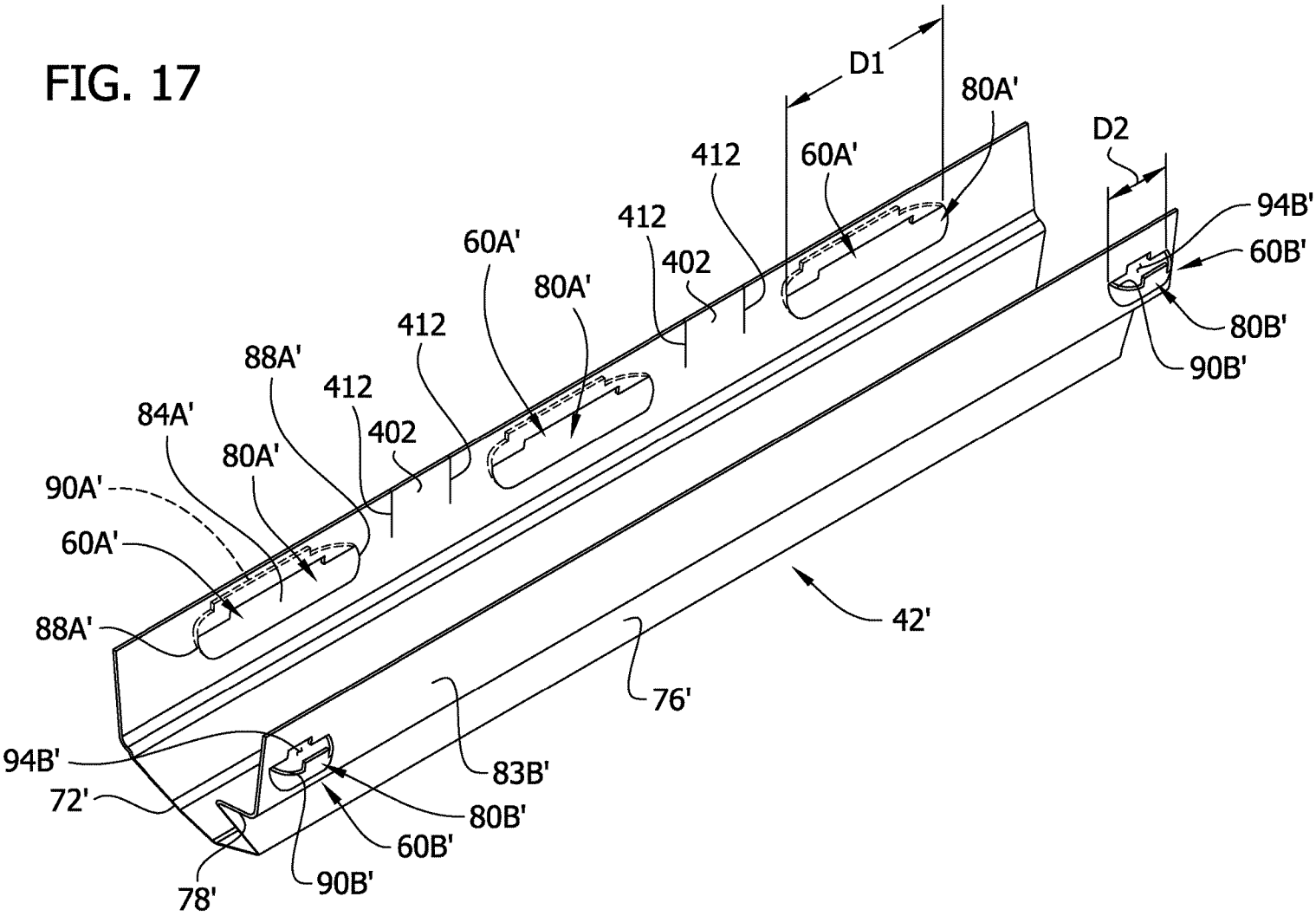
FIG. 17 is a perspective view of the upper end cap of FIG. 15 prior to assembly of the end cap with the upper panel member.
Figure 19:
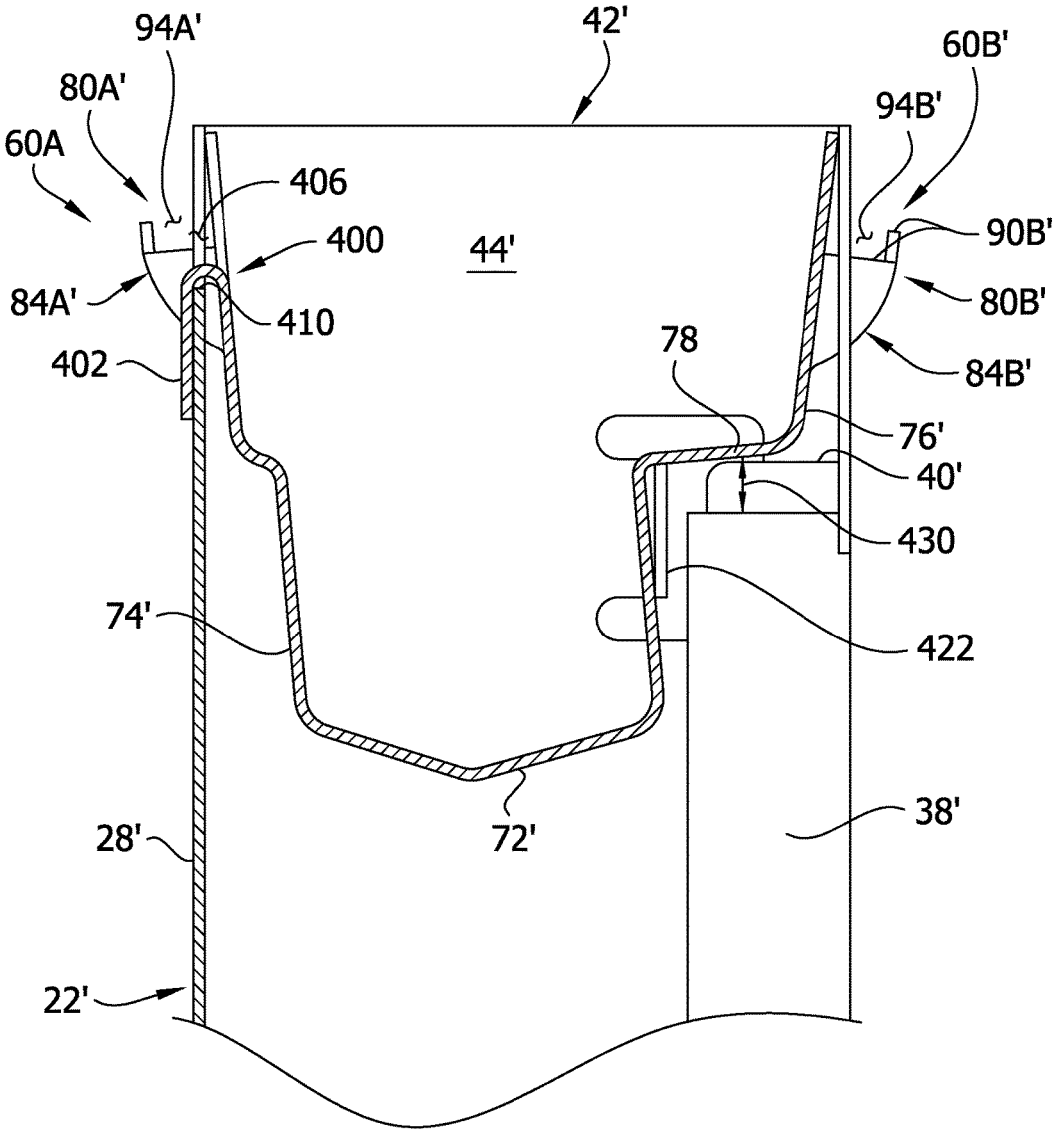
FIG. 19 is an enlarged vertical section taken in the plane of line 19-19 of FIG. 18.

Desirably, the end caps 42', 62' are also formed (e.g., stamped) from sheet metal or other suitable material. As best illustrated in FIGS. 17 and 19, each end cap 42', 62' has the shape of a channel comprising a base wall 72' and first and second opposite side walls 74', 76' extending from the base wall. The walls 72', 74', 76' define the respective cavity 44', 64' for receiving the respective end seal 46', 66'. The second side wall 76' of each end cap 42', 62' is formed with a generally horizontal shoulder 78'.

Figure 20:
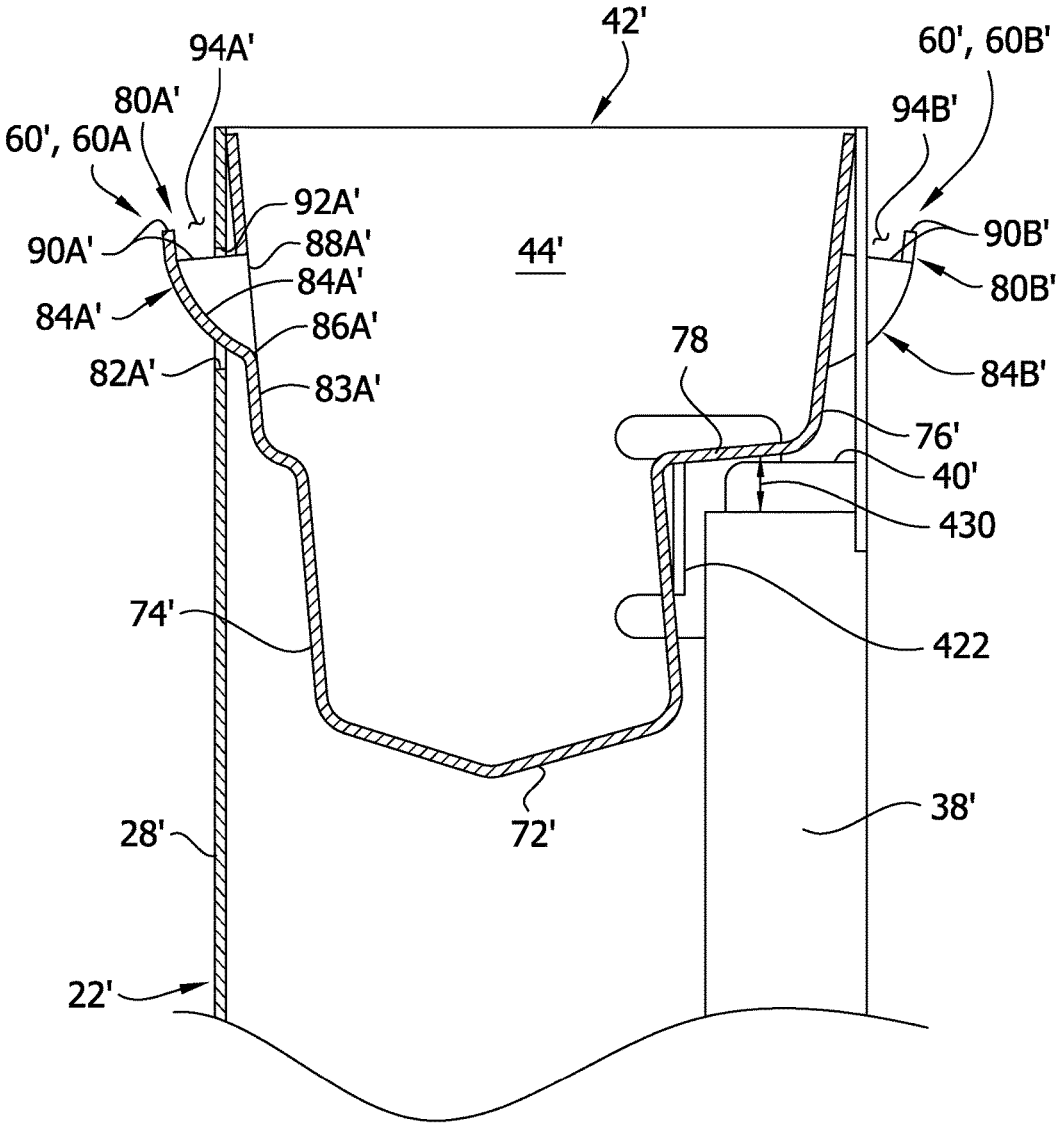
FIG. 20 is an enlarged vertical section taken in the plane of line 20-20 of FIG. 18.

Referring to FIGS. 18 and 20, the first set of one or more louver connections 60' connecting the first (upper) end cap 42' to the first panel member 22' comprises at least one and desirably more than one louver connection 60A' between the first side wall 74' of the first end cap 42' and the web 28' of the first panel member, and at least one and desirably more than one louver connection 60B' between the second side wall 76' of the first end cap and the in-turned lips 36' of the first panel member. Each louver connection 60A' comprises a louver, generally designated 80A', on the first end cap 42' projecting outward through a louver opening 82A' in the side wall 74' of the first panel member 22'. Similarly, each louver connection 60B' comprises a louver, generally designated 80B', on the first end cap 42' projecting outward through a louver opening 82B' in the in-turned lip 36' of the first panel member 22'. The louver connections 60A' and 60B' are identical to the louver connections 60A and 60B of the panel 20 of the first embodiment described above, and corresponding parts are referred to by corresponding reference numbers with the addition of a prime designator (').

The louver connections 60A', 60B' hold the upper end cap 42' in a stable position against movement relative to the first panel member 22' when the aforesaid extending force is applied to the first end cap 42'. Desirably, the reception of the edges 92A', 92B' of the louver openings 82A', 82B' in respective slots 94A', 94B' minimizes rotation (roll) of the end cap 42' relative to the respective panel member 22'.

The louver connections 70A', 70B' between the lower end cap 62' and the lower panel member 24' are configured in the same way as louver connections 60A' and 60B', and in the same way as louver connections 70A and 70B of the panel 20 of the first embodiment.

The louver connections 60', 70' described above comprise louvers on respective end caps 42', 62' projecting outward through louver openings in respective panel members 22', 24'. However, it will be understood that this arrangement could be reversed. That is, the louvers could be on respective panel members 22', 24' and project inward through louver openings in respective end caps 42', 62'.

The number of louver connections 60A', 60B', 70A', 70B' will vary depending on strength needed to maintain the attachment between the end caps 42', 62', and respective panel members 22', 24' when forces F1, F2 are applied to the end caps (as by the aforementioned jack) to extend the panel members relative to one another to bring the end seals 46', 66' into sealing engagement with opposing surfaces (e.g., roof and floor) of a mine passage. Also, the size and configuration of the louver connections 60A', 60B', 70A', and 70B' can vary as needed or desired. For example, the length of the louvers 80A', 80B' can vary from one louver connection to another louver connection. By way of example, as shown in FIG. 17, the louvers 80A' of the louver connections 60A' may have a relatively long side-to-side dimension D1 (e.g., 1.75 in), while the louvers 80B' of louver connections 60B' may have a shorter side-to-side dimension D2 (e.g., 0.75 in).

It will be observed that, as in the first and second panels 20, 220, the first set of one or more louver connections 60A', 60B' of panel 20' may not be effective in holding the first end cap 42' against movement relative to the first panel member 22' when a contracting force F3 (FIG. 15) is applied to the first end cap tending to telescopically contract the first panel member 22' relative to the second panel member 24' in a second (downward) direction along the axis A1 opposite a first (upward) direction. Similarly, the second set of one or more louver connections 70A', 70B' may not be effective in holding the second end cap 62' against movement relative to the second panel member 24' when a contracting force F4 (FIG. 1) is applied to the second end cap tending to telescopically contract the second panel member 24' relative to the first panel member 22' in a second (upward) direction along the axis A1 opposite the aforesaid first (downward) direction. Contracting forces F3 and F4 may be applied to one or both panel members 22', 24' during convergence of the roof and floor of a mine after the panel 20' has been installed, and/or during the process of assembling, shipping, and installing the panel 20', and/or during recovery of the panel 20' for re-use.

Referring again to FIGS. 15 and 18, the panel 20' is configured to resist (limit) telescopic movement of the first end cap 42' relative to the first panel member 22' when a contracting (downward) force F3 is applied to the first end cap tending to telescopically contract the first panel member relative to the second panel member 24' along the axis A1. In this particular embodiment, the panel 20' has three features for resisting the downward contracting force F3 (hereinafter "downward loading" features).

The first such downward loading feature comprises at least one device 400 on the first end cap 42' configured for engagement with the first panel member 22'. In the illustrated embodiment, the end cap has two such devices, each comprising a stop in the form of a tab 402 on the first end cap 42' bent to a position for engagement by the first panel member 22'. As illustrated best in FIGS. 18 and 19, each tab 402 is formed as an integral part of the upstanding side wall of the end cap 42' and projects outward through an opening 406 in the web 28' of the first panel member 22'. The tab 402 extends from the opening generally in the stated second direction (downward) along an exterior surface of the web 28' of the first panel member. In this embodiment, the opening 406 comprises a generally rectangular notch (also designated 406) extending down from the upper edge of the web 28' of the panel member 22', and the tab 402 is bent down for engagement with the bottom edge 410 of the notch 406 (see FIG. 19). The tab opening 406 may have other configurations. When a contracting (downward) force F3 is applied to the end cap 42', the engagement of the tabs 402 with the bottom edges 410 of respective notches 406 limits downward displacement of the end cap relative to the first panel member 22'. By limiting such downward displacement, the louvers 80A', 80B' of the louver connections 60A', 60B' are retained in respective louver openings 82A', 82B' when the upper end cap 42' is subjected to the downward contracting force F3.

The tabs 402 may have other configurations. By way of example but not limitation, the tabs may project up from respective side walls of the 74', 76' of the upper end cap 42' and bend (fold) down over the upper edge of the web 28' of the upper panel member 22'. In this embodiment, the tab openings 406 may be eliminated. The tabs 402 may vary in number (e.g., one, two, three, etc.) and/or size and/or shape.

FIG. 17 illustrates the upper end cap 42' prior to assembly of the end cap with the upper panel member 22'. At this stage, the tabs 402 are not yet bent and are defined by vertical slits 412 in the side wall of the end cap. After the end cap 42' is assembled with the panel member 22', the tabs 402 are bent down (folded over) to the positions shown in FIGS. 18 and 19. The seal 46' is then placed in the cavity 44' of the end cap 42'.

The second downward loading feature comprises one or more devices 420 on the first panel member 22' configured for engagement by the first end cap 42' to limit telescopic movement of the first end cap relative to the first panel member 22' when a contracting (downward) force F3 is applied to the first end cap. In the illustrated embodiment, two such devices 420 are provided, one on each side flange 30' of the upper (first) panel member 22'. Referring to FIGS. 15 and 19, each device 420 comprises a stop in the form of a tab 422 formed as an integral part of a respective flange 30'. The tabs 422 extend inward for engagement by the end cap and, more specifically, by the shoulder 78' of the end cap. When a contracting (downward) force F3 is applied to the upper end cap 42', the engagement of the tabs 422 with the shoulder 78' limits downward displacement of the end cap relative to the upper panel member 22'. By limiting such downward displacement, the louvers 80A', 80B' are retained in respective louver openings 82A', 82B' when the upper end cap 42' is subjected to the downward contracting force F3.

Figure 16:
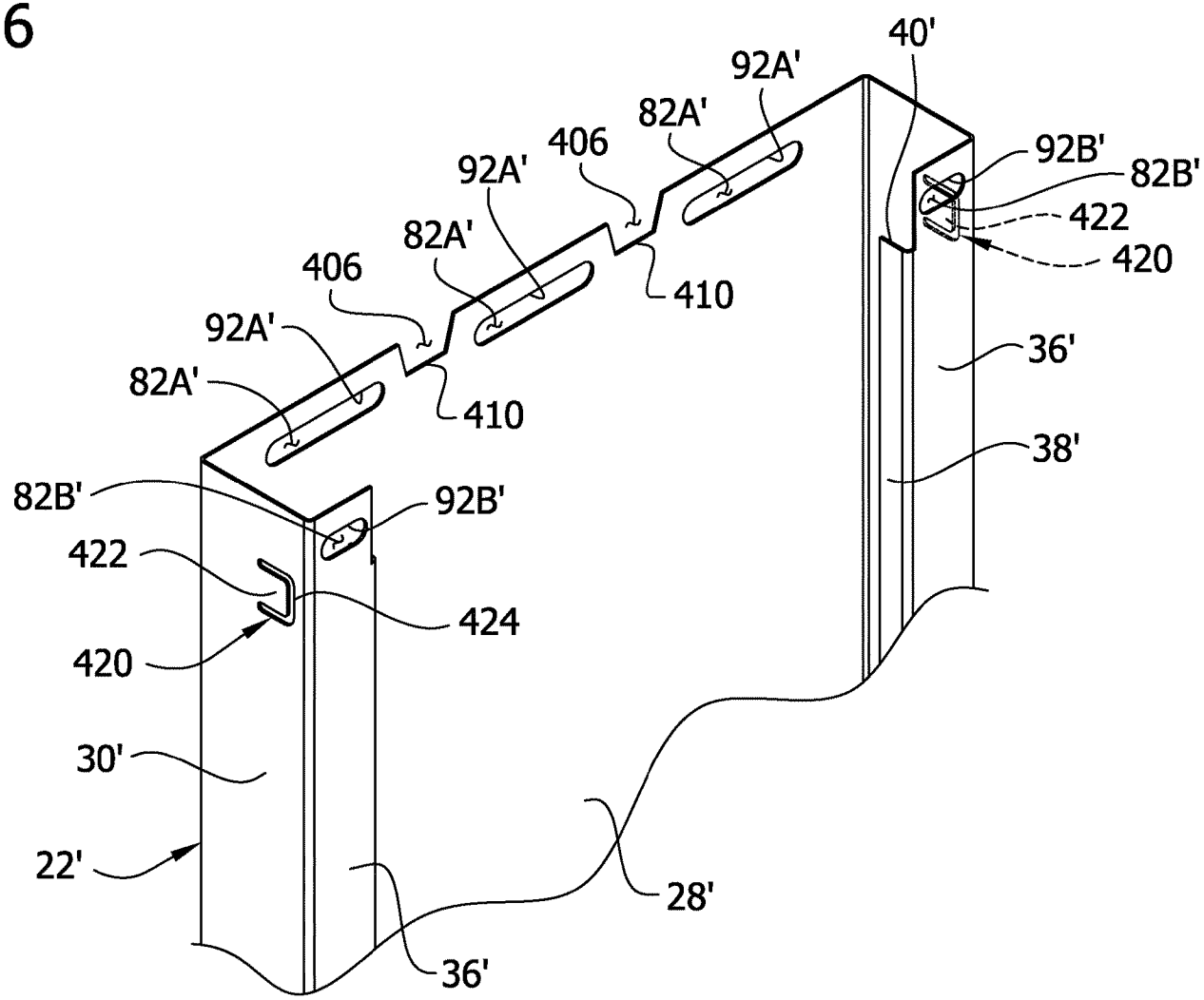
FIG. 16 is an enlarged upper end portion of the upper panel member of the stopping panel of FIG. 15.

FIG. 16 illustrates the first panel member 22' prior to assembly with the upper end cap 42'. At this stage, the tabs 422 are not yet bent and are defined by U-shaped slits 424 in the side flanges 30' of the panel member 22'. After the end cap 42' is assembled with the panel member 22', the tabs 422 are bent (folded over) to the positions shown in FIGS. 15 and 18.

The third downward loading feature comprises the upper terminal edges 40' of the edge margins 38' of the in-turned lips 36' of the panel member 22'. The upper end cap 42' in general, and the shoulder 78' of upper end cap in particular, engages the upper terminal edges 40' to limit downward telescopic movement of the end cap relative to the upper panel member 22' when the contracting (downward) force F3 is applied to the upper end cap.

Desirably, when the panel 20' is finally assembled, a gap 430 exists between the upper terminal edges 40' and the shoulder 78' of the upper end cap 42' (see FIG. 19). During assembly of the upper end cap 42' and the panel member 22', this gap 430 allows the upper end cap to be moved down into a position between the flanges 30' of the upper panel member 22' a distance sufficient to permit lateral movement of the louvers 80A', 80B' into respective louver openings 82A', 82B', and then moved up a short distance so that the upper edges of the louver openings are located in the louver slots 94A', 94B'. Desirably, the end cap 42', or the edge margins 38' of the panel member 22', or both, are resiliently deformable such that the gap 430 expands to a size large enough to allow the louvers to spring into respective louver openings during assembly of the end cap and the panel member, and then contract to a size small enough to inhibit movement of the louvers out of respective louver openings after assembly is complete. In one embodiment, the extent of expansion and contraction of the 430 is in the range of 0.040-0.060 in.

In the illustrated embodiment, at least the first two downward loading features act substantially simultaneously to resist a contracting force F3. That is, the engagement of the tabs 402 with the bottom edges 410 of respective notches 406, and the engagement of the end cap 42' with the tabs 422 are substantially simultaneous so that the two features reinforce one another to resist the contracting force. The third downward loading feature reinforces the first two downward loading features if the upper end cap 42' moves downward under the contracting force F3 a distance equal to the size of the gap 430 (see FIG. 21). The three downward loading features continue to work in unison even if the contracting force F3 is sufficiently large to cause the louvers to move out of their respective louver openings.

In other embodiments, each of the three downward loading features described above may be used alone or in combination with either or both of the other two reverse loading features to resist a contracting force F3. By way of example but not limitation, a panel of this invention may include one or more stops like the stops 110, 120 in FIG. 1 and, in addition, one or more stops like the stops 400, 500 in FIGS. 15 and 22.

Similarly, the panel 20' is configured to resist telescopic movement (upward displacement) of the second end cap 62' relative to the second panel member 24' when a contracting (upward) force F4 is applied to the second end cap tending to telescopically contract the second panel member 24' relative to the first panel member 22' along the axis A1. In this particular embodiment, the panel 20' has three features for resisting the upward contracting force F4 (hereinafter "upward loading" features). These three upward loading features are comparable to the three downward loading features described above and are best exemplified by the constructions illustrated in FIGS. 15, 21, and 22.

Figure 22:
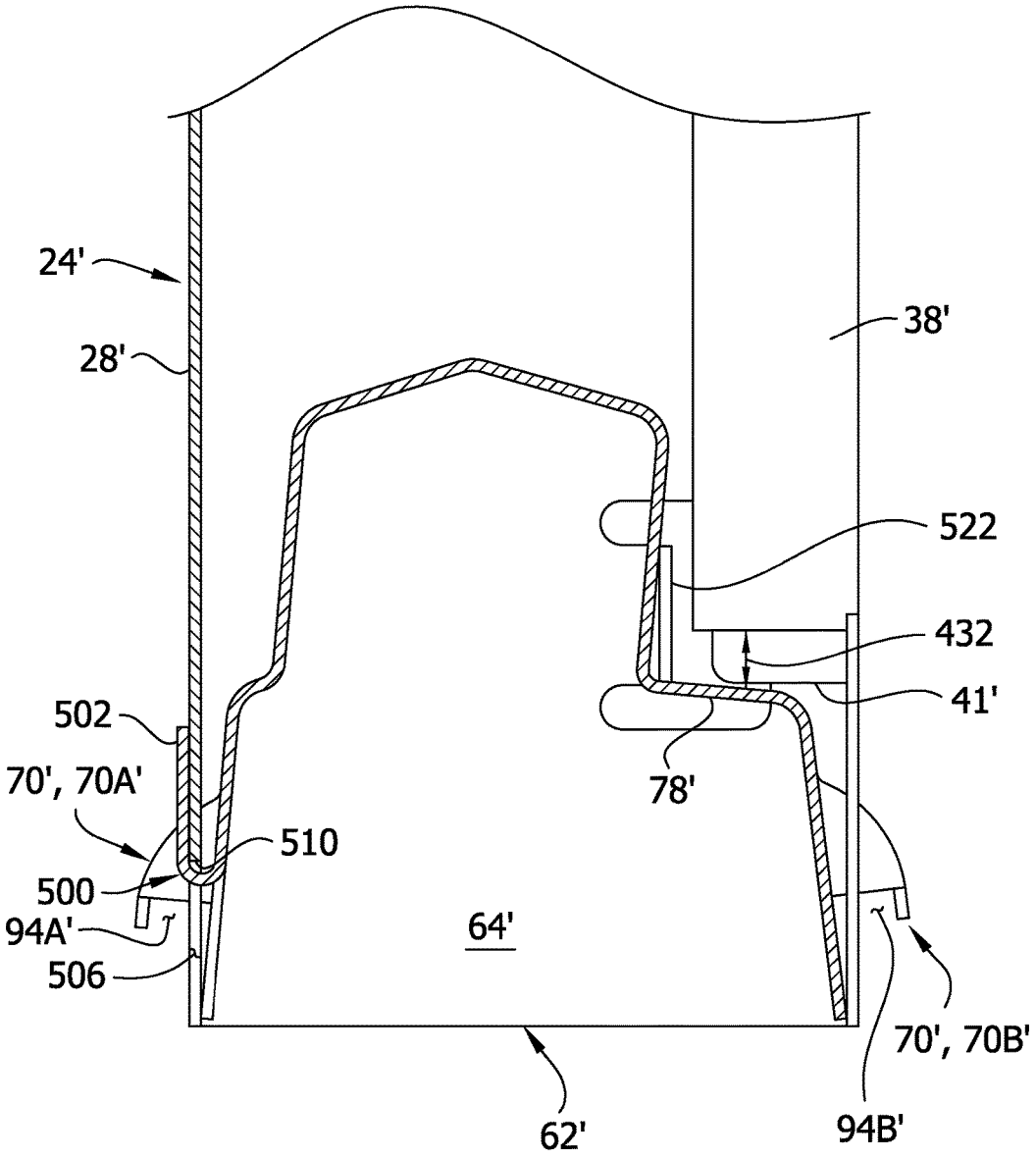
FIG. 22 is an enlarged vertical section taken in the plane of line 22-22 of FIG. 15 illustrating reverse loading features of the lower panel member and the lower end cap of the stopping panel.

The first such upward loading feature comprises at least one device 500 on the second end cap 62' configured for engagement with the second panel member 24' (see FIG. 22). In the illustrated embodiment, the end cap has two such devices (only one is shown in FIG. 22). Each device 500 is similar to the devices 400 described above and comprises a stop in the form of a tab 502 on the second end cap 62' bent to a stop position for engagement by the second panel member 24'. As illustrated best in FIG. 22, each tab 502 is formed as an integral part of the upstanding side wall of the end cap 62' and projects outward through an opening 506 in the web 28' of the second panel member 24'. The tab 502 extends from the opening generally in the stated second direction (upward) along an exterior surface of the web 28' of the second panel member. In this embodiment, the opening 506 comprises a generally rectangular notch (also designated 506) extending up from the lower edge of the web 28' of the panel member 24', and the tab 502 is bent up for engagement with the upper edge 510 of the notch 506. The tab opening 506 may have other configurations. When a contracting (upward) force F4 is applied to the end cap 62', the engagement of the one or more tabs 502 with the upper edges 510 of respective notches 506 limits upward displacement of the lower end cap 62' relative to the lower panel member 24'. By limiting such upward displacement, the louvers of the louver connections 270A, 270B are retained in respective louver openings when the lower end cap 62' is subjected to the upward contracting force F4.

The tabs 502 may also have other configurations. By way of example but not limitation, the tabs may project down from respective side walls of the 74', 76' of the lower end cap 42' and fold (bend) up under the lower edge of the web 28' of the lower panel member 24'. In this embodiment, the tab openings 506 may be eliminated. The tabs 502 may vary (e.g., one, two, three, etc.) in number and/or size and/or shape.

The second upward loading feature comprises one or more devices 520 on the lower panel member 24' configured for engagement by the lower end cap 62' to upward limit telescopic movement of the second end cap relative to the second panel member 24' when a contracting (upward) force F4 is applied to the second end cap. In the illustrated embodiment, two such devices 520 are provided (only one is shown in FIG. 15), one on each side flange 30' of the second panel member 24'. The devices 520 are similar to the devices 420 described above. Referring to FIGS. 15 and 22, each device 520 comprises a stop in the form of a tab 522 formed as an integral part of a respective flange 30'. The tabs 522 extend inward for engagement by the end cap and, more specifically, by the shoulder 78' of the end cap. When a contracting (upward) force F4 is applied to the end cap 62', the engagement of the one or more tabs 522 with the shoulder 78' limits upward displacement of the end cap relative to the lower panel member 24'. By limiting such upward displacement, the louvers of the louver connections 270A, 270B are retained in respective louver openings when the lower end cap 62' is subjected to the upward contracting force F4.

The third upward loading feature comprises the lower terminal edges 41' of the edge margins 38' of the in-turned lips 36' of the panel member 24' (see FIGS. 15 and 20). The lower end cap 62' in general, and the shoulder 78' of lower end cap in particular, engages the lower terminal edges 41' to limit upward telescopic movement of the end cap relative to the lower panel member 24' when the contracting (upward) force F4 is applied to the lower end cap.

When the panel 22' is finally assembled, a gap 432 exists between the lower terminal edges 41' and the shoulder 78' of the lower end cap 62' (see FIGS. 19 and 20). During assembly, this gap 432 allows the lower end cap 42' to be moved up between the flanges 30' of the lower panel member 24' a distance sufficient to permit lateral movement (e.g., resilient snap action) of the louvers of the louver connections 70A', 70B' into respective louver openings, and then moved up a short distance so that the upper edges of the louver openings are located in the louver slots 94A', 94B' (see FIGS. 21 and 22). Desirably, the end cap 42', or the edge margins 38' of the panel member 22', or both, are resiliently deformable such that the gap 430 expands to a size large enough to allow the louvers to spring into respective louver openings during assembly of the end cap and the panel member, and then contract to a size small enough to inhibit movement of the louvers out of respective louver openings after assembly is complete. In one embodiment, the extent of expansion and contraction of the 430 is in the range of 0.040-0.060 in.

In the illustrated embodiment, at least the first two upward loading features act substantially simultaneously to resist a contracting force F4. That is, the engagement of the tabs 503 with the bottom edges 510 of respective notches 506, and the engagement of the end cap 62' with the tabs 522 are substantially simultaneous so that both features reinforce one another to resist the contracting force F4. The third upward loading feature reinforces the first two upward loading features if the lower end cap 62' moves upward under the contracting force F4 a distance equal to the size of the gap 432 (see FIG. 22). The three upward loading features continue to work in unison even if the contracting force F4 is sufficiently large to cause the louvers to move out of their respective louver openings.

In other embodiments, each of the three upward loading features described above may be used alone or in combination with either or both of the other two upward loading features to resist a contracting force F4.

The components of the panel 20' are easy to assemble. In this regard, the upper end cap 42' is assembled with the upper panel member 22' by moving the end cap down into a position between the flanges 30 of the panel member, as illustrated in FIG. 15. During this downward movement, the opposing walls of the 74', 76' of the end cap and/or the sheet material of the upper panel member 22' resiliently deform until the louvers 80A', 80B' of the louver connections 60A', 60B' are able to spring into respective louver openings 82A', 82B' and thereby snap fasten the end cap to the upper panel member. Thus, the louver connections 60A', 60B' may be considered to be mechanical snap fastening connections connecting the upper end cap to the upper panel member. Similarly, the lower end cap 62' is assembled with the lower panel member 24' in substantially the same way, and the louver connections 70A', 70B' secure the lower end cap to the lower panel member. After assembly of the end caps and the panel members, the tabs 402, 405 on the upper and lower end caps 42', 62' are bent into the positions shown in FIGS. 19 and 22, and the tabs 422, 522 are bent into the positions shown in FIGS. 15, 19, and 21. The upper and lower end seals 46', 66' are also placed in respective cavities 44', 64' of the upper and lower end caps 42', 62'.

Other louver connection configurations and configurations for resisting movement of the end caps against contracting forces are possible. By way of example but not limitation, it will be understood that the louver connections between the end caps and the panel members may be at locations different from the locations described above. For example, the end caps may have end walls, and the louver connections may be between the flanges 30 of the panel members and the end walls of the end caps. Alternatively, the louver connections may be between only one of the side walls (e.g., 74, 76) of the end cap and either the web 28 of the panel member or the in-turned flanges 36 of the panel member. Also, while the mine stopping panels 20, 220, 20' described have upper and lower end caps both of which have louver connections with respective panel members, it will be understood that one of the end caps can have louver connections with its respective panel member and the other end cap can have another type of connection with its respective panel member.

Also, in the embodiments described above, the end caps have cavities for holding seals for sealing engagement with mine surfaces. It will be understood that the seals and seal cavities in one or both end caps may be eliminated in other embodiments. By way of example but not limitation, the end caps may incorporate barbs or other anchoring mechanisms for engaging the mine surfaces, or the end caps may be devoid of any such mechanisms.

A method of this invention for making a mine stopping panel comprises a number of steps, exemplified by the foregoing description. In general, the method comprises the steps of:

(i) forming an elongate channel-shaped panel member having a longitudinal axis, a web, first and second flanges at opposite sides of the web, and in-turned lips at outer edges of the flanges;

(ii) forming an elongate end cap having opposite ends;

(iii) forming a first bendable tab (e.g., 110, 422, 402) on one of the panel member and the end cap before the panel member and end cap are assembled;

(iv) assembling the formed panel member and the formed end cap so that the end cap extends across the web of the panel member in a position in which the ends of the end cap are adjacent respective first and second flanges of the panel member and the end cap is positioned between the web and in-turned flanges of the panel member (e.g., as in FIG. 1 or FIG. 15);

(v) making at least one connection (e.g., 60, 60') between the panel member and the end cap to hold the end cap against movement relative to the first panel member along the longitudinal axis of the panel member in a first direction; and (vi) bending the first tab (e.g., 110, 422, 402) into a position in which it extends from said one of the panel members and the end cap for engagement with the other of the panel members and the end cap to resist movement of the end cap relative to the panel member along the longitudinal axis of the panel member in a second direction opposite said first direction.

In one embodiment, the first bendable tab (e.g., 402) referred to in step (iii) above is on the end cap. In another embodiment, the first bendable tab (e.g., 110, 422) is on the panel member. In another embodiment, the first bendable tab (e.g., 402) is on the end cap, and the method further comprises forming a second bendable tab (e.g., 110, 422) on the panel member before the panel member and end cap are assembled, and bending the second tab after assembly of the end cap and panel member into a position in which the second tab extends from the panel member for engagement with the end cap to resist movement of the end cap relative to the panel member along the longitudinal axis of the panel member in a second direction opposite the stated first direction.

Having described the invention in detail, it will be apparent that modifications and variations are possible without departing from the scope of the invention defined in the appended claims.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions without departing from the scope of the invention, it is intended that all matter contained in the above description and shown in the accompanying drawing shall be interpreted as illustrative and not in a limiting sense.

What is claimed is:

1. A mine stopping panel comprising a first elongate panel member and a second elongate panel member, each panel member having a web, and first and second flanges at opposite sides of the web, said first and second panel members having a telescoping sliding fit one of said first and second panel members inside the other of said first and second panel members along an axis extending lengthwise of the panel members, a first end cap extending between the first and second flanges of the first panel member on an inside surface of the web of the first panel member, at least one louver connection between the first panel member and the first end cap holding the first end cap against movement relative to the first panel member when an extending force is applied to the first end cap tending to telescopically extend the first panel member relative to the second panel member in a first direction along said axis, and at least one first device on the first end cap configured for engagement with the first panel member to resist telescopic movement of the first end cap relative to the first panel member when a contracting force is applied to the first end cap tending to telescopically contract the first panel member relative to the second panel member in a second direction along said axis opposite said first direction;

wherein said at least one louver connection comprises a louver projecting through a louver opening, the louver of said louver connection being upset from a first region of the first end cap or the first panel member to have a louver body having a front wall having a base edge integrally joined to the first region, the louver body having opposite side walls integrally joined to the first region and to the front wall, and the front wall further having a free edge opposite the base edge spaced outward from the first region for engagement by an opposing edge of said louver opening when said extending force is applied to the first end cap.

2. A mine stopping panel as set forth in claim 1, wherein the at least one first device comprises at least one tab on the first end cap bent around the first panel member and extending proximate to an exterior surface of the first panel member.

3. A mine stopping panel as set forth in claim 2, wherein the at least one tab is bent around the web of the first panel member.

4. A mine stopping panel as set forth in claim 1, further comprising a stop on at least one flange of the first panel member extending inward from the flange for engagement by the first end cap to limit telescopic movement of the first end cap relative to the first panel member when said contracting force is applied to the first end cap.

5. A mine stopping panel as set forth in claim 4, further comprising an in-turned lip at an outer edge of the first flange of the first panel member, and wherein the in-turned lip of the first panel member has an in-turned edge margin extending toward the web of the first panel member, said in-turned edge margin having an edge located for engagement by the first end cap to limit telescopic movement of the first end cap relative to the first panel member when said contracting force is applied to the first end cap.

6. A mine stopping panel as set forth in claim 1, further comprising an in-turned lip at an outer edge of the first flange of the first panel member, and wherein the in-turned lip of the first panel member has an in-turned edge margin extending toward the web of the first panel member, said in-turned edge margin having an edge located for engagement by the first end cap to limit telescopic movement of the first end cap relative to the first panel member when said contracting force is applied to the first end cap.

7. A mine stopping panel as set forth in claim 1, wherein the louver is resiliently urged into the louver opening.

8. A mine stopping panel as set forth in claim 1, wherein the louver body is configured to define a slot between said free edge of the front wall and said first region of the first end cap for receiving said opposing edge of said louver opening.

9. A mine stopping panel as set forth in claim 1, further comprising an in-turned lip at an outer edge of the first flange of the first panel member, and wherein the first end cap has a base wall and first and second opposite side walls extending from the base wall, said at least one louver connection comprising at least one louver connection between the second side wall of the first end cap and the in-turned lip of the first panel member.

10. A mine stopping panel as set forth in claim 9, wherein the base wall and first and second opposite side walls define a first cavity for receiving a first seal.

11. A mine stopping panel as set forth in claim 1, further comprising an elongate second end cap extending between the first and second flanges of the second panel member on an inside surface of the web of the second panel member, at least one connection between the second panel member and the second end cap holding the second end cap against movement relative to the second panel member when an extending force is applied to the second end cap tending to telescopically extend the second panel member relative to the first panel member in said second direction along said axis, and at least one second device on the second end cap configured for engagement with the second panel member to resist telescopic movement of the second end cap relative to the second panel member when a contracting force is applied to the second end cap tending to telescopically contract the second panel member relative to the first panel member in said first direction along said axis opposite said second direction.

12. A mine stopping panel as set forth in claim 11 wherein the at least one second device comprises at least one tab on the second end cap bent around an edge of the second panel member and extending along an exterior surface of the second panel member.

13. A mine stopping panel as set forth in claim 12, wherein the at least one tab on the second end cap projects through an opening in the web of the second panel member.

14. A mine stopping panel as set forth in claim 1, wherein said first end cap comprises a base wall and a first side wall extending from the base wall, and the at least one first device comprises at least one tab on the first end cap, the at least one tab having a base integrally joined to and extending from a region of the first side wall, the tab extending from the base to a free end of the tab, the tab having an intermediate section between the base and the free end, the tab having a bend section between the base and the intermediate section, the tab being sufficiently bent at the bend section to position the intermediate section of the tab with respect to said region to form a gap between the intermediate section of the tab and said region, the first panel member being received in said gap.

15. A mine stopping panel as set forth in claim 14, wherein the bend section of the tab defines a concave recess in which the first panel member is received.

16. A mine stopping panel as set forth in claim 14, wherein the bend section extends from the base of the tab upwardly and laterally from said region of the first side wall and then downwardly and laterally toward the free end of the tab.

17. A mine stopping panel as set forth in claim 16, wherein the bend section and the intermediate section of the tab define a J shape.

18. A mine stopping panel as set forth in claim 14, wherein the intermediate section of the tab has an inwardly facing surface and said region of the first side wall has an outwardly facing surface, said inwardly facing surface and said outwardly facing surface opposing each other at the gap and having the first panel member received therebetween.

19. A mine stopping panel as set forth in claim 14, wherein the intermediate section of the tab is generally parallel with said region of the first wall.

20. A mine stopping panel as set forth in claim 14, wherein the tab turns more than 45 degrees at the bend section.

21. A mine stopping panel as set forth in claim 14, wherein the at least one louver connection comprises at least one louver connection between the first side wall of the first end cap and the web of the first panel member.

22. A mine stopping panel as set forth in claim 21, wherein the end cap comprises a second side wall extending from the base wall, and the end cap further comprises at least one louver connection between the second side wall of the first end cap and an in-turned lip on the first flange of the first panel member.

23. A mine stopping panel as set forth in claim 8, wherein the opposite side walls of the louver body are recessed relative to the free edge of the front wall to define said slot.

24. A mine stopping panel as set forth in claim 5, wherein the at least one first device engages the first panel member at a location other than at said edge of the in-turned edge margin.

25. A mine stopping panel comprising a first elongate panel member and a second elongate panel member, each panel member having a web, and first and second flanges at opposite sides of the web, said first and second panel members having a telescoping sliding fit one of said first and second panel members inside the other of said first and second panel members along an axis extending lengthwise of the panel members, a first end cap extending between the first and second flanges of the first panel member on an inside surface of the web of the first panel member, at least one louver connection between the first panel member and the first end cap holding the first end cap against movement relative to the first panel member when an extending force is applied to the first end cap tending to telescopically extend the first panel member relative to the second panel member in a first direction along said axis, and at least one first device on the first end cap configured for engagement with the first panel member to resist telescopic movement of the first end cap relative to the first panel member when a contracting force is applied to the first end cap tending to telescopically contract the first panel member relative to the second panel member in a second direction along said axis opposite said first direction;

wherein said at least one louver connection comprises a louver projecting through a louver opening;

wherein the louver of said at least one louver connection has a louver body having a surface positioned for engagement by an opposing edge of said louver opening when said extending force is applied to the first end cap, said surface of the louver body comprising a free edge opposite a base edge of the louver body joined to the first end cap, said free edge including an elevated segment and end segments on opposite sides of the elevated segment depressed toward the base edge relative to the elevated segment to define a slot for receiving said opposing edge of said louver opening, said slot extending between the end segments of the free edge and having slot end portions sized for receiving said opposing edge of said louver opening, the slot end portions at the end segments of the free edge being recessed into the louver body toward the base edge relative to the elevated segment of the free edge, the louver body having a height measured parallel to the axis, the height extending from the base edge to the elevated segment of the free edge such that the louver body overlaps the opposing edge of the louver opening in a heightwise direction of the louver body parallel to said axis when the opposing edge of the louver opening is received in said slot.

* * * * *